US009732491B2

(12) United States Patent
Pierce, Jr.

(10) Patent No.: US 9,732,491 B2
(45) **Date of Patent: *Aug. 15, 2017**

(54) WATER SUPPRESSOR AND SEDIMENT COLLECTION SYSTEM FOR USE IN SHALLOW AND DEEPER WATER ENVIRONMENTS

(71) Applicant: Webster Pierce, Jr., Cut Off, LA (US)

(72) Inventor: Webster Pierce, Jr., Cut Off, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/231,680

(22) Filed: Aug. 8, 2016

(65) Prior Publication Data

US 2017/0067218 A1 Mar. 9, 2017

Related U.S. Application Data

(63) Continuation of application No. 14/667,281, filed on Mar. 24, 2015, now Pat. No. 9,410,299, which is a (Continued)

(51) Int. Cl.
*E02B 3/04* (2006.01)
*E02B 3/06* (2006.01)
(Continued)

(52) U.S. Cl.
CPC ..... *E02B 3/06* (2013.01); *E02B 3/023* (2013.01); *E02B 3/04* (2013.01); *E02B 3/046* (2013.01); *E02B 3/062* (2013.01); *E02B 3/18* (2013.01)

(58) Field of Classification Search
USPC ..... 405/15, 21, 23, 25, 29, 30, 73, 74, 80, 405/87; 137/512.1, 527.8; 210/170.1, (Continued)

(56) References Cited

U.S. PATENT DOCUMENTS 1,368,042 A 2/1921 Miller
3,289,417 A 12/1966 Girden
(Continued)

FOREIGN PATENT DOCUMENTS

CN 1245236 2/2000
EP 0285202 10/1988
(Continued)

OTHER PUBLICATIONS

PCT International Search Report and Written Opinion of the International Searching Authority, for International Patent Application Serial No. PCT/US2014/019095, Filed on Feb. 27, 2014.
(Continued)

*Primary Examiner* — Sean Andrish
(74) *Attorney, Agent, or Firm* — Garvey, Smith & Nehrbass, Patent Attorneys, LLC; Julia M. FitzPatrick; Gregory C. Smith

(57) ABSTRACT

A transportable wave suppressor and sediment collection system for suppressing wave action along the shore of a body of water, which includes a plurality of interconnected sections, each section including a base, a forward wall, and a rear wall, and having a plurality of flow pipes extending from the forward wall to the rear wall, and further including a plurality of shelves on the forward wall for dispersing wave energy, while redirecting and using the wave energy to allow water and sediment to flow into the flow pipes and for collecting sediment that is not carried into the flow pipes and settles on the shelves for being contacted by a following wave to carry the sediment into the flow pipes. In some deeper water embodiments, the sections may include a base portion, a top portion and one or more spacer portions to enable raising or changing the height of the system.

20 Claims, 34 Drawing Sheets

Related U.S. Application Data continuation of application No. 14/192,519, filed on Feb. 27, 2014, now Pat. No. 8,985,896, which is a continuation-in-part of application No. 13/554,202, filed on Jul. 20, 2012, now Pat. No. 9,157,204, which is a continuation-in-part of application No. 12/576,359, filed on Oct. 9, 2009, now Pat. No. 8,226,325.

(60) Provisional application No. 61/772,368, filed on Mar. 4, 2013.

(51) Int. Cl.
*E02B 3/02* (2006.01)
*E02B 3/18* (2006.01)

(58) Field of Classification Search
USPC ..... 210/170.11
See application file for complete search history.

(56) References Cited

U.S. PATENT DOCUMENTS

| | | | |
|---|---|---|---|
| 3,373,568 | A | 3/1968 | Hornbostel, Jr. |
| 3,387,458 | A | 6/1968 | Jarlan |
| 3,464,211 | A | 9/1969 | Andresen |
| 3,632,508 | A | 1/1972 | Girden |
| 4,367,978 | A | 1/1983 | Schaaf et al. |
| 4,448,571 | A | 5/1984 | Eckels |
| 4,479,740 | A | 10/1984 | Schaaf et al. |
| 4,502,816 | A | 3/1985 | Creter, Jr. et al. |
| 4,708,521 | A | 11/1987 | Kocourek |
| 4,711,598 | A | 12/1987 | Schaaf et al. |
| 4,978,247 | A | 12/1990 | Lenson |
| 5,022,784 | A | 6/1991 | DeVries et al. |
| 5,150,988 | A | 9/1992 | Powell et al. |
| 5,439,316 | A | 8/1995 | Richardson |
| 5,489,165 | A | 2/1996 | Smith |
| 5,895,174 | A | 4/1999 | Beaver |
| 6,561,730 | B2 | 5/2003 | Yang |
| 6,955,759 | B2 | 10/2005 | Patrick et al. |
| 7,029,200 | B1 | 4/2006 | Cravens |
| 7,165,912 | B2 | 1/2007 | Herzog |
| 7,507,056 | B2 | 3/2009 | Spry |
| 7,708,494 | B2 | 5/2010 | McLaughlin |
| 8,226,325 | B1 | 7/2012 | Pierce, Jr. |
| 8,985,896 | B2 | 3/2015 | Pierce, Jr. |
| 9,410,299 | B2 | 8/2016 | Pierce, Jr. |
| 2002/0012571 | A1 | 1/2002 | Nichols |
| 2005/0123352 | A1 | 6/2005 | Peyton |
| 2006/0056913 | A1 | 3/2006 | Herzog |
| 2006/0104719 | A1 | 5/2006 | Fainman et al. |
| 2009/0148243 | A1 | 6/2009 | McGinn et al. |
| 2009/0154996 | A1 | 6/2009 | Liner |

FOREIGN PATENT DOCUMENTS

| | | |
|---|---|---|
| GB | 1492624 | 11/1977 |
| JP | 01036811 | 2/1989 |
| KR | 20070038196 | 4/2007 |
| RU | 2373328 | 11/2009 |
| WO | WO8909308 | 10/1989 |

OTHER PUBLICATIONS

PCT Preliminary Report on Patentability of the International Searching Authority, for International Patent Application Serial No. PCT/US2010/052182, Filed on Oct. 11, 2010.

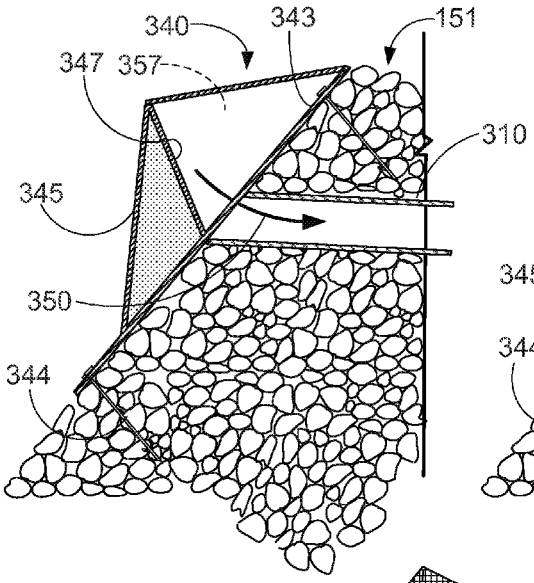
FIG. 32A
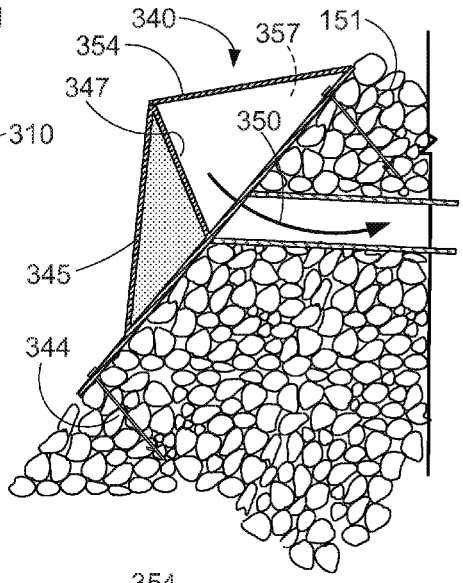
FIG. 32B
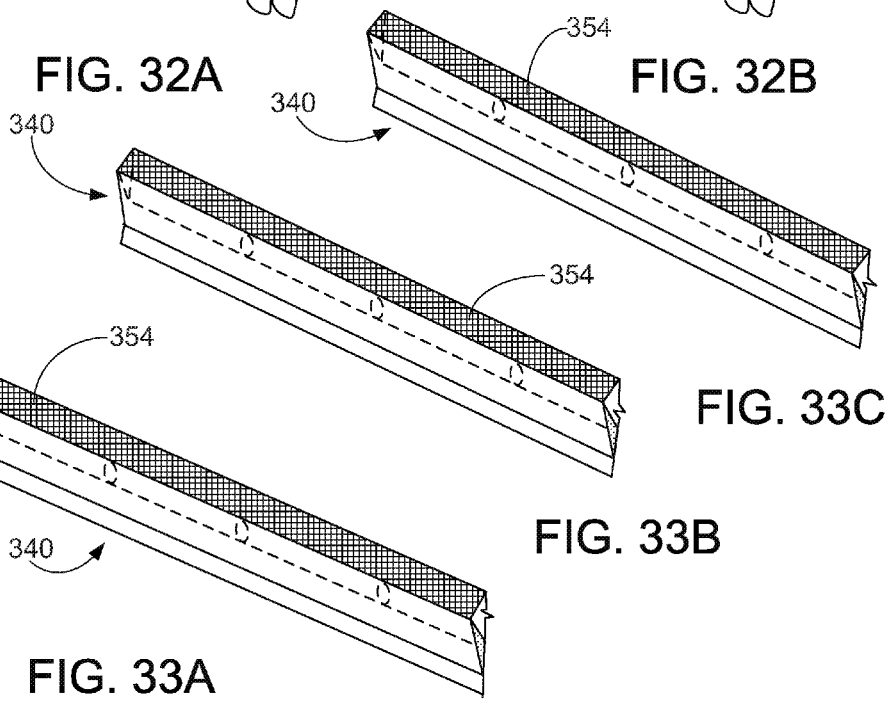
FIG. 33C
FIG. 33B
FIG. 33A

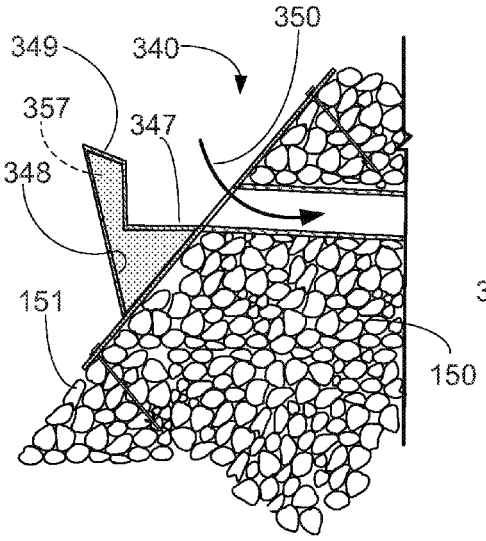
FIG. 35A
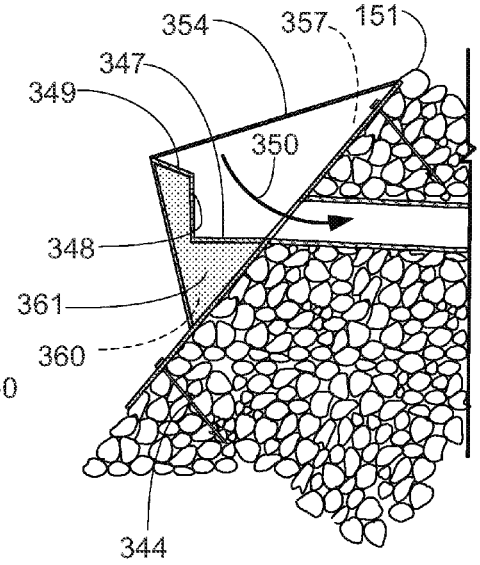
FIG. 35B
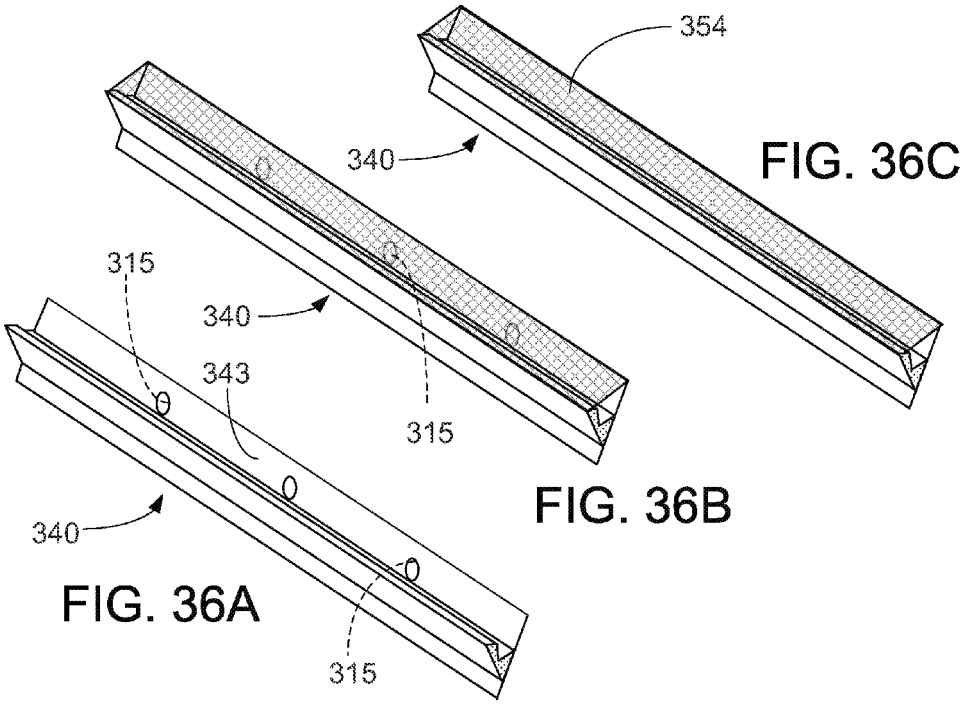
FIG. 36C
FIG. 36B
FIG. 36A

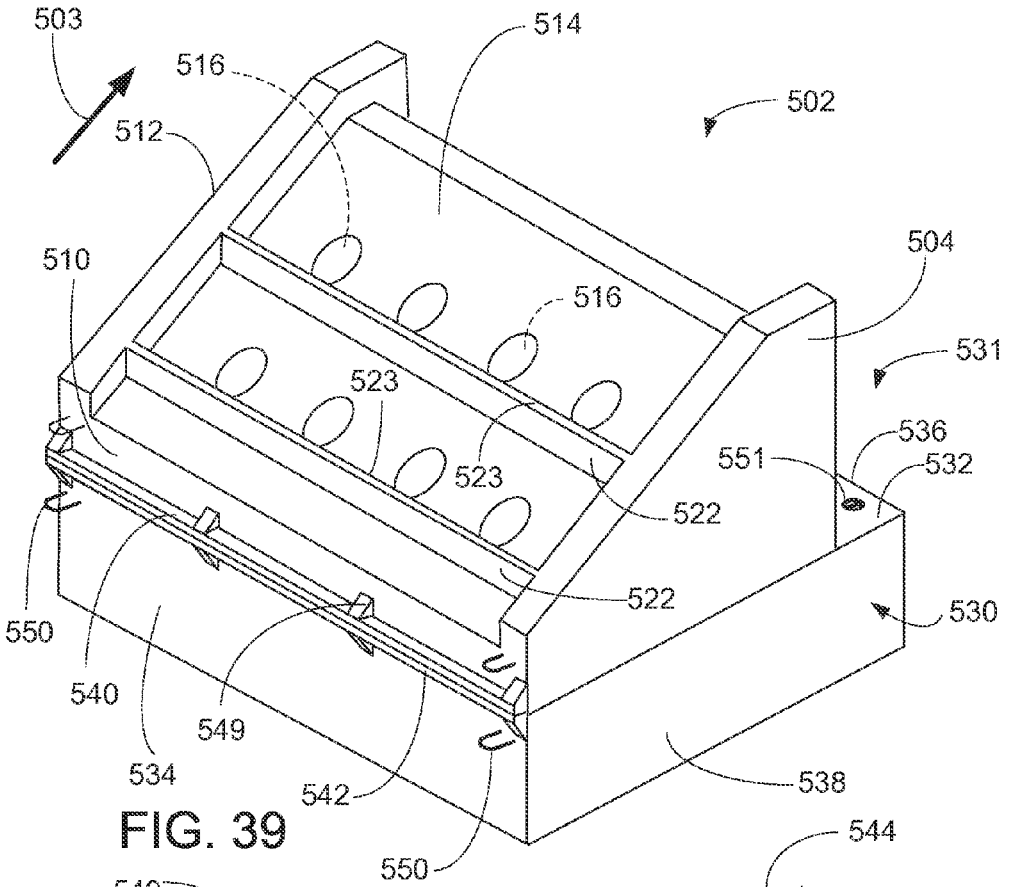
FIG. 39
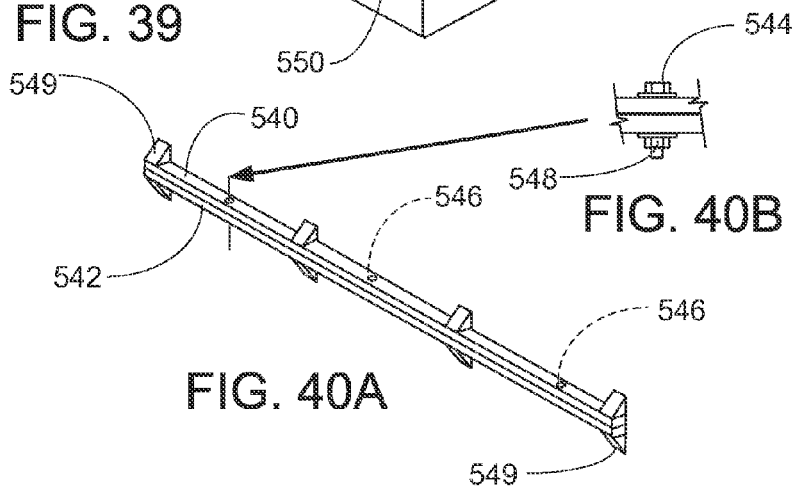
FIG. 40B
FIG. 40A

WATER SUPPRESSOR AND SEDIMENT COLLECTION SYSTEM FOR USE IN SHALLOW AND DEEPER WATER ENVIRONMENTS

CROSS-REFERENCE TO RELATED APPLICATIONS

This is a continuation of U.S. patent application Ser. No. 14/667,281, filed on 24 Mar. 2015, which is a continuation of U.S. patent application Ser. No. 14/192,519, filed on 27 Feb. 2014 (issued as U.S. Pat. No. 9,410,299 on Aug. 9, 2016), which claims the benefit of U.S. Provisional Patent application Ser. No. 61/772,368, filed on 4 Mar. 2013, each of which is hereby incorporated herein by reference thereto, and priority to and/or the benefit of each of which is hereby claimed.

U.S. patent application Ser. No. 14/192,519, filed on 27 Feb. 2014 is a continuation-in-part of U.S. patent application Ser. No. 13/554,202, filed on 20 Jul. 2012 (published as US2013/0022399 on 24 Jan. 2013), which is a continuation-in-part of U.S. patent application Ser. No. 12/576,359, filed on 9 Oct. 2009 (issued as U.S. Pat. No. 8,226,325 on 24 Jul. 2012) by the same inventor, each of which are hereby incorporated herein by reference thereto, and priority to each of which is hereby claimed.

International Patent Application Serial No. PCT/US2014/019095, filed on 27 Feb. 2014 (published as No. WO2014/137752 on 12 Sep. 2014), and International Patent Application Serial No. PCT/US2010/052182, filed on 11 Oct. 2010 (published as No. WO2011/044556 on 14 Apr. 2011), are each hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to protection from coastline erosion caused by wave action or tidal surge and the restoration of coastline lost from such wave action or tidal surge activity. More particularly, the present invention relates to a wave suppressor and sediment collection system (sometimes referred to as the WSSC System) which is transportable and can be installed along a coastline which provides a sufficient barrier to disrupt the tidal wave flow into the coastline while at the same time allowing sediment to be carried through the system by the wave action and water currents and to be trapped and deposited at points between the system and the coastline to allow coastline restoration to occur.

2. General Background of the Invention

The loss of valuable coastline for states along the Gulf of Mexico, Atlantic Ocean and Pacific Ocean is a very serious problem. For example, using the Gulf of Mexico as an example, for thousands of years, the flow of the Mississippi during flood stages, carried rich soil and sediment into Louisiana and the result was the creation of a vast fertile Mississippi River delta region which was inhabitable and where crops could flourish. In recent times, with the discovery of oil and gas beneath the Louisiana coast, oil companies have built a vast system of canals in order to allow boats and self-contained drilling rigs to be transported inland in order to recover the oil and gas. This vast system of canals has allowed the intrusion of salt water into the lower delta, and by doing so has killed off thousands of acres of valuable marsh land, which had helped maintain the valuable soil in place. In addition, the marshland served as a first barrier against the onslaught of hurricanes and helped slow down the movement of the storms and reduce the storm surge before the storm reached habitable portions of the state.

However, with the loss of valuable marsh grass, the soil became susceptible to erosion, and consequently miles of valuable coastline were lost. It is estimated that coastal erosion by the flow of the tides on a daily basis results in a loss of many square miles of coastline. Furthermore, the reduction in the marsh land has resulted in the reduction of protection from hurricane storm surge and wind velocity. Many believe that Hurricane Katrina was a prime example of a hurricane that came ashore and because there was little marshland to hinder its winds and surge, resulted in the enormous amount of wind and water to be carried far inland.

Therefore, there is a need in two vital areas. The first is a system, such as was provided by the barrier islands years ago, which would hinder or reduce the surge of tidal water inland during normal tidal cycles, and also during storms, so that the surge does not damage the coastline. Second, there is a need for a system which would allow the wave action to move through the system, carrying with it tons of sand and other silt material, buoyant in the water, but the sand and silt being trapped between the system and the shoreline and forced to be deposited and increase the solid material which would eventually form additional coastline.

The following US Patents are incorporated herein by reference:

TABLE

| PATENT NO. | TITLE | ISSUE DATE DD-MM-YYYY |
|---|---|---|
| 3,373,568 | System for Reclamation of Land | 03-19-1968 |
| 3,387,458 | Seawall Structures | 06-11-1965 |
| 3,632,508 | Method and Apparatus for Desilting and/or Desalting Bodies of Water | 01-04-1972 |
| 4,367,978 | Device for Preventing Beach Erosion | 01-11-1983 |
| 4,479,740 | Erosion Control Device and Method of Making and Installing Same | 10-30-1984 |
| 4,708,521 | Beach Building Block | 11-24-1987 |
| 4,978,247 | Erosion Control Device | 12-18-1990 |
| 7,029,200 | Shoreline Erosion Barrier | 04-18-2006 |
| 7,165,912 | Apparatus for Rebuilding a Sand Beach | 01-23-2007 |
| 7,507,056 | Apparatus for Controlling Movement of Flowable Particulate Material | 03-24-2009 |
| 2009/0154996 | Shoreline and Coastal Protection and Rebuilding Apparatus and Method | 06-18-2009 |
| 4,711,598 | Beach Erosion Control Device | 12-09-1997 |

BRIEF SUMMARY OF THE INVENTION

The system of the present invention solves the problems in a straightforward manner. In a first principal embodiment, what is provided is a transportable system to reduce tidal surge wave action and provide land restoration along the shore of a body of water, such as a coastline, which includes a plurality of interconnected sections of the system, each section including a base, a forward wall, and a rear wall, having a plurality of fluid flow pipes extending from the forward wall to the rear wall, for allowing water including sediment to flow into the pipes at the forward wall and exit the pipes at the rear wall. There is further provided a one-way valve member at the rear wall exit of each pipe, so that water carrying sediment cannot return through the pipe as the wave action recedes from the coastline. To allow water to return to the body of water, there is provided a flow opening including a weir between multiple sections so that water is able to flow therethrough. Each of the sections would be self-contained, and constructed of a material to allow each section to be floated or transported to a location, wherein material, such as water, or the like, can be pumped into each section resulting in the section to sink and rest on the floor of the body of water, with an upper portion of the section extending a distance above the water surface. The sections would be interconnected and anchored to the floor, so as to provide a continuous system, interrupted only by the water return outlets as stated earlier.

The systems described above would further provide inlet and outlet valves on each individual section for allowing material to be pumped into each section in order to sink each section as described earlier; and when sections have to be transported to another location the valving would allow the material to be pumped from each section, resulting in each section becoming buoyant and transportable or barged to another location to be reassembled into multi-sections as described earlier.

Further, it is foreseen that the forward wall of each section would include a shelf or shoulder extending outward below each row of water flow pipes so as to catch any sediment that may not flow through the pipes initially, but would be carried through by a subsequent wave action.

In another deeper water embodiment, the WSSC system is positionable in deep water along, for example, a coastline of a body of water, including a plurality of sections or units, each unit further having an upper portion of the type disclosed in the first principal embodiment herein secured to a base portion through a novel attachment system; the lower end of the base portion secured into the floor of the body of water; there could be further provided a spacer portion secured between the upper portion and the base portion through the novel attachment system; the base portion having no openings in the wall, while the spacer portions include a plurality of flow pipes extending from the forward wall to the rear wall for allowing water carrying sediment to flow therethrough similar to the top portion; a plurality of one way valves on the rear end of the flow pipes for preventing water with sediment from returning into the flow pipes.

In another embodiment, the system as described above would include a secondary system stationed in the water ahead of the system, which would include one or multiple barges, each barge having an air compressor system, preferably powered by wind and solar energy, to buildup compressed air in tanks, and upon water reaching a certain level, automatically releasing the compressed air through openings at the ends of a plurality of air lines which would be able to rove along the water bottom, resulting in the pressurized air stirring and fluffing up sand and silt from the water bottom. This would provide a great amount of additional sand and silt becoming suspended in the water and being carried through the land restoration system and deposited between the system and the coastline, thus greatly increasing the amount of sediment built up between the system and the coastline.

It is foreseen that as sediment is built up, as described above, the entire system could be relocated to another position in order to build up sediment in another area. The entire system could stretch over a short distance, or it could stretch over miles of coastline, depending on the need in an area.

In the most simple embodiment of the system, it is foreseen that when a rock jetty or dam is constructed, as of the type which will dam the opening of the "Mr Go" Channel in south Louisiana, a plurality of flow pipes of the type described above could be positioned through the rock dam, so that some water carrying sediment could flow through the pipes, but not an amount to cause a tidal surge, and in doing so would be depositing sediment on the land side of the dam, so that over time sediment is deposited to the point of resulting in land accumulation.

Therefore, it is a principal object of the present invention to construct a device that would suppress the energy of a wave to effectively break down the energy in a wave; use the energy of the wave to help collect sediment; and use the energy of the wave to help rebuild coastal south Louisiana.

It is a second principal object of the present invention to protect the environment by helping to collect sediment and protect the existing shore line, and helping to collect sediment and protect the existing levee systems exposed to open water.

It is a third principal object of the present invention to speedup sediment recovery by holding and preventing the sediment from leaving the confined area and returning to open water and be lost forever.

It is a fourth principal object of the present invention to act as secondary sediment barriers by confining sediment to certain areas, and using this newly developed method of keeping sediment suspended so as to take advantage of the energy found in the waves.

It is a fifth principal object of the present invention to provide a barrier made from concrete or recycled rubber material, which is designed to float, or made of a light material such as (HDPE) high density polyethylene, or lightweight concrete designed to float, or that can be made from recycled rubber, such as used tires, or which can be made from the most economical material.

It is a sixth principal object of the present invention to recycle the barrier device by removing the water from inside the barrier and float or barge to a new site and use it again.

It is a seventh principal object of the present invention to use the barrier wall as sediment retainer when sediment is pumped from a known source.

It is an eighth principal object of the present invention to provide a designated pipeline used to move sediment from a river by retaining most of the sediment if not all of it; stopping erosion of newly deposited material; and stopping polluting and contaminating areas that otherwise are not designed to receive any sediment.

It is a ninth principal object of the present invention to provide weirs strategically located to maximize the sediment recovery; and It is a tenth principal object of the present invention to be an island builder by completely surrounding an area, letting the waves bring the sediment and building up the island.

It is a further principal object of the present invention to provide a system which will be constructed and applied in such a way as to have no adverse effect of the ecology of the environment the WSSC System is placed into.

It is a further object of the present invention to construct a device that could be used in deep water and would rest on or be integral to a large, raised base, so the device could suppress the energy of a wave in deeper water to effectively break down the energy in a wave; use the energy of the wave to help collect sediment; and use the energy of the wave to help rebuild coastline, such as coastal south Louisiana and other coastal areas;

It is a further principal object of the present invention to construct a system that could be used in deeper or shallow water and would include one or more spacer portions between the upper portion and the large, raised base, to allow the system to function in deep water environments, and to suppress the energy of a wave in deeper water to effectively break down the energy in a wave; use the energy of the wave to help collect sediment; and use the energy of the wave to help rebuild coastline, such as coastal south Louisiana and other coastal areas.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 32A and 32B illustrate cross-section views of a single drainage pipe in a drainage component of the WSSC System and the first embodiment of the construction of the continuous trough for receiving the flow of water and sediment into the drainage component;

FIGS. 33A through 33C illustrate cutaway views of the troughs secured to the ends of the drainage pipes used in the first embodiment of the construction of the continuous trough used in the WSSC System;

FIGS. 35A and 35B illustrate cross-section views of a single collection pipe in a collection component of the WSSC System and the second embodiment of the construction of the continuous trough for receiving the flow of water and sediment into the drainage component;

FIGS. 36A through 36C illustrate cutaway views of the troughs secured to the ends of the drainage pipes used in the second embodiment of the construction of the continuous trough used in the WSSC System;

FIG. 39 illustrates an overall view of a unit of the deep water system having a base portion secured to an upper portion;

FIGS. 40A and 40B illustrate overall or isolated views, respectively, of the flange attachment between portions of a unit of the system;

FIG. 43B illustrates an isolated view of a flapper valve mounted on the rear wall of the unit illustrated in FIG. 42;

DETAILED DESCRIPTION OF THE INVENTION

Figure 11:
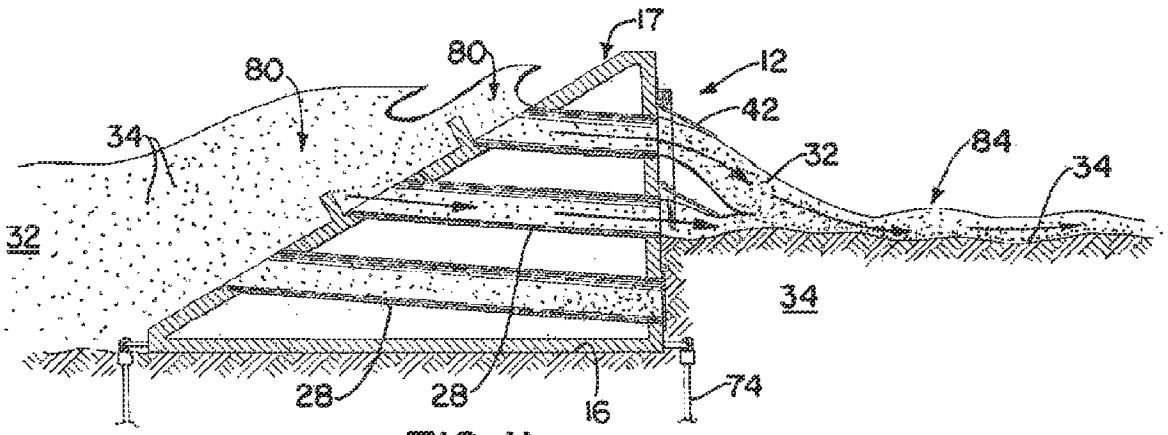
FIG. 11 is a side cutaway of a preferred embodiment of the WSSC System of the present invention illustrating sediment buildup to the rear of the system.
Figure 12A:
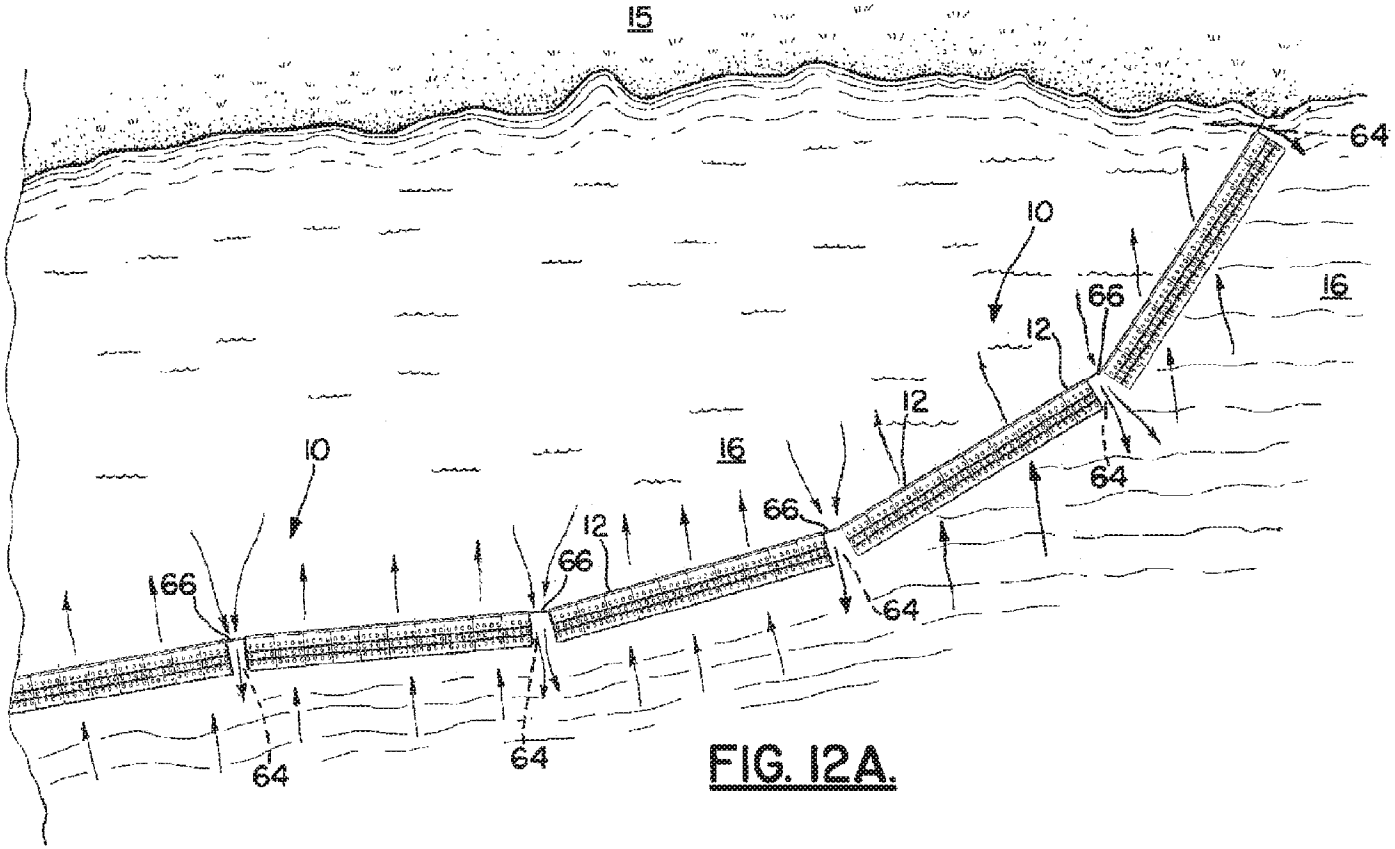
FIG. 12A is an aerial view of the WSSC System in place along a shoreline in a body of water.

FIGS. 1 through 49 illustrate a preferred embodiment of the Wave Suppressor and Sediment Collection (WSSC) System 10 of the present invention, as seen in overall aerial view in FIG. 12A, where the system 10 is in place near a shoreline 15. However, for details of the WSSC system 10, reference is made to various drawing FIGS. 1 through 17, as it would be used as a free-standing system. FIGS. 18 through 25 illustrate a first embodiment of the WSSC System positioned within a rock jetty, FIGS. 26A through 36C illustrate a second embodiment of the WSSC System positioned within a rock jetty. FIGS. 37 through 49 illustrate the deep water embodiment of the WSSC System of the invention. Before reference is made to the WSSC System installed through a rock jetty, or in deep water, the WSSC System will be described when in is self-standing in place near a shore line as set forth in FIGS. 1 through 17.

Figure 1:
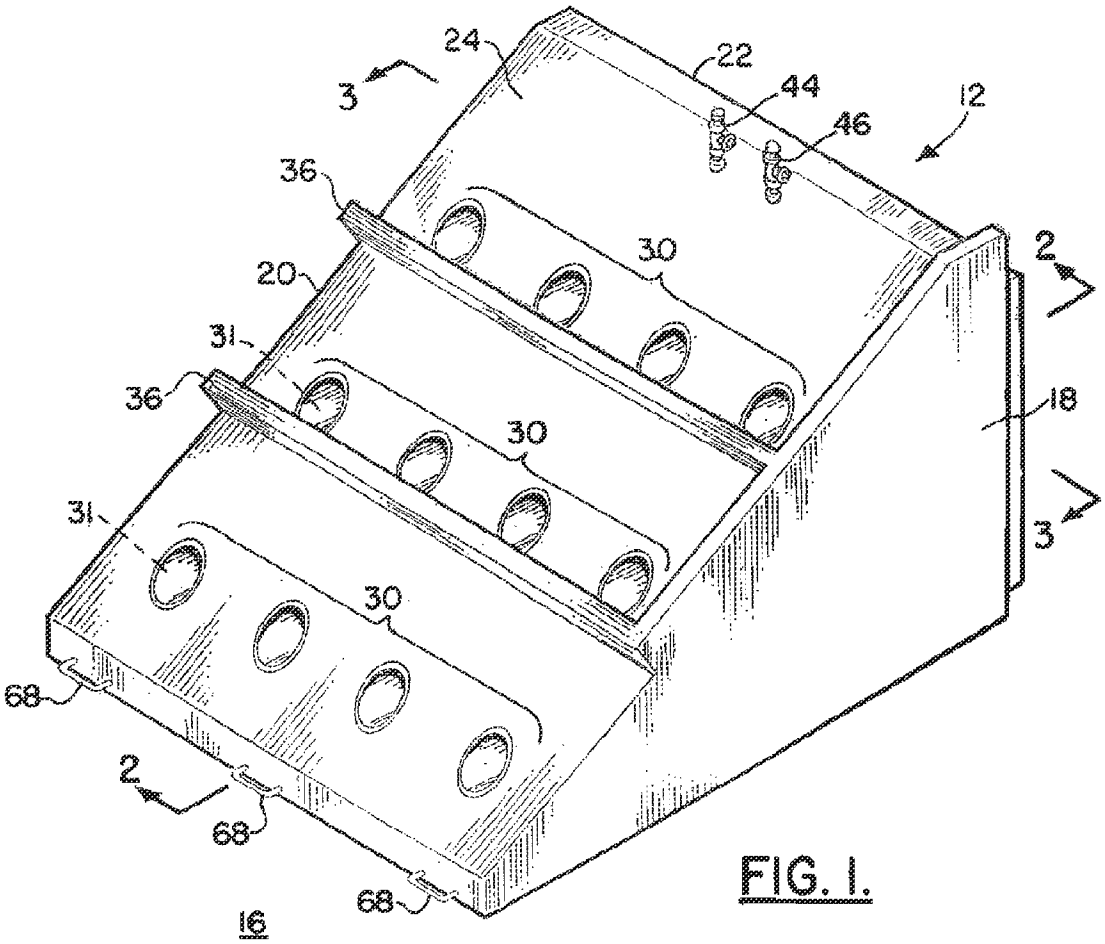
FIG. 1 is an overall perspective view of a section in a preferred embodiment of the WSSC System of the present invention.
Figure 2:
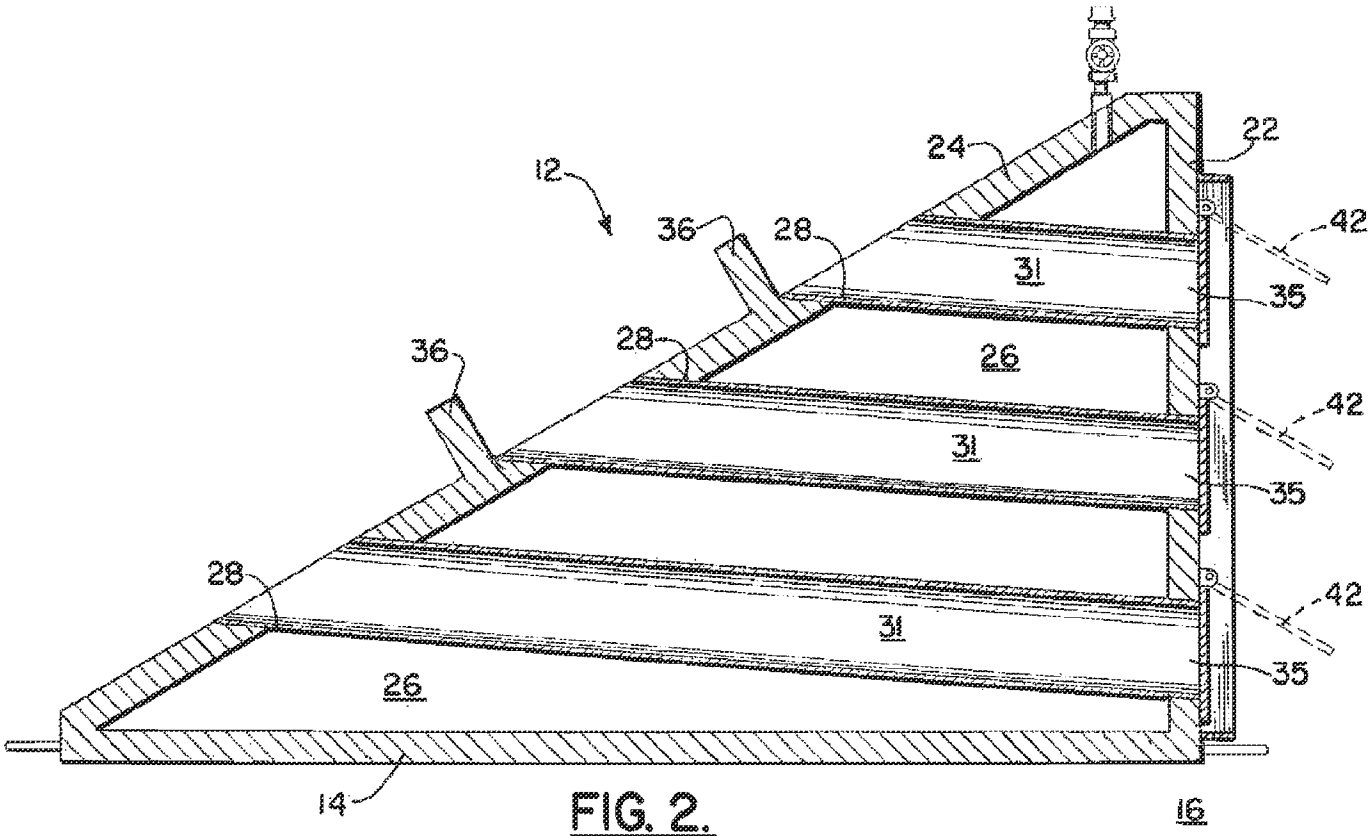
FIG. 2 is a side cutaway view along lines 2-2 in FIG. 1 of a preferred embodiment of the WSSC System of the present invention.
Figure 3:
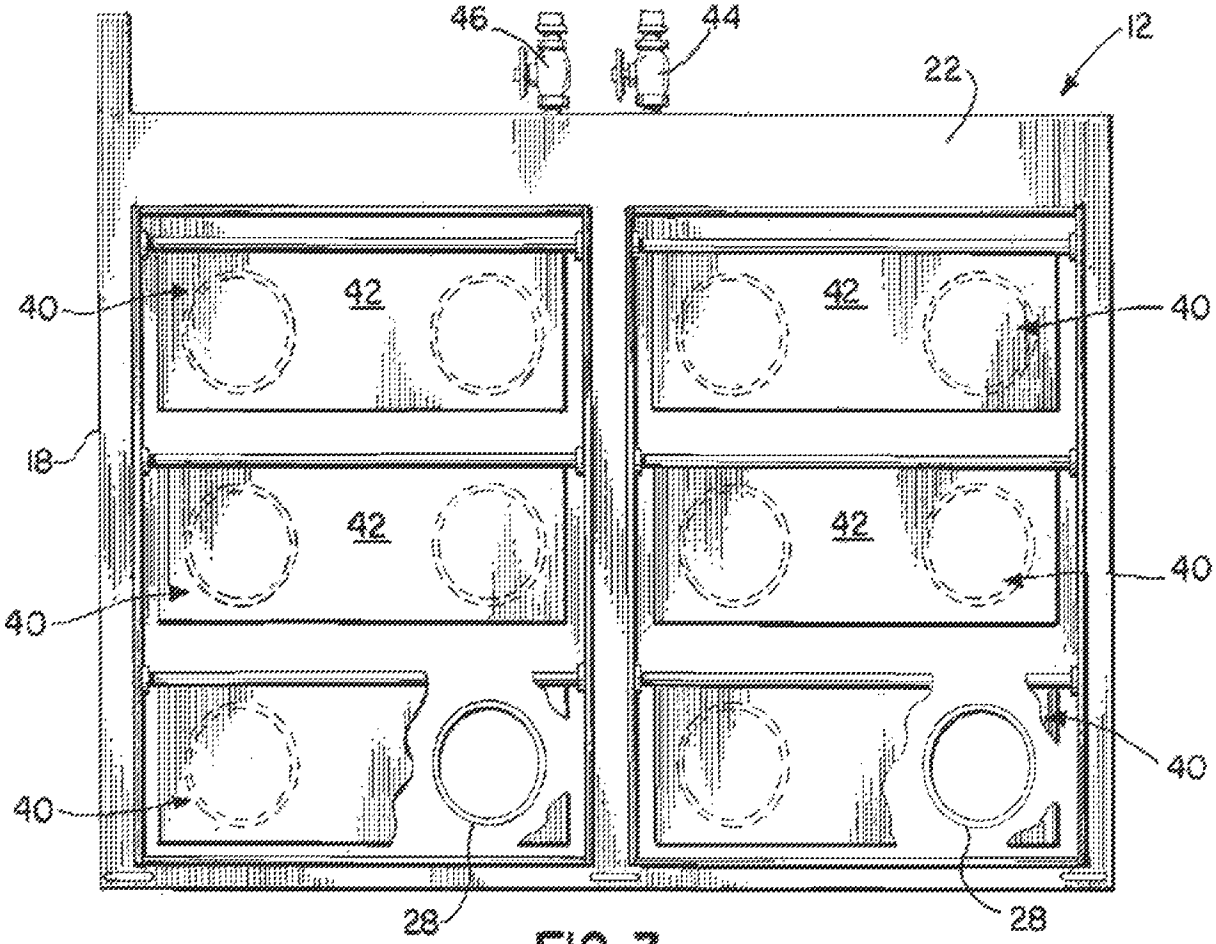
FIG. 3 is a rear partial cutaway view along lines 3-3 in a preferred embodiment of the WSSC System of the present invention.

The WSSC System 10 of the present invention comprises a plurality of sections 12 that will be more fully described in FIGS. 1 through 3. As illustrated, each section 12 includes a base 14 for resting on a sea floor 16. There is provided a pair of substantially triangular shaped side walls 18, 20, a rear wall 22 and sloped top wall 24, all together defining an interior space 26 therein. It is foreseen that each section 12 would be fabricated from a material, such as rubber, from discarded tires, or other material, such as high density polyethylene (HDPE) or concrete, if necessary. Each section 12 further comprises a plurality of tubular members 28, such as PVC (polyvinyl chloride) pipe having a certain diameter, preferably set in three rows 30, the tubular members 28 extending from the top wall 24, through the space 26 and terminating in the rear wall 22. Each tubular member has a flow bore 31 therethrough for allowing water 32 carrying sediment 34 (See FIG. 10, e.g.) to flow from a point in front of each section 12, through each tubular member 28, and exit through the rear opening 35 of each tubular member 28, through the rear wall 22 to a point to the rear of each section 12, into the area 37 between the system 10 and a shoreline, as will be described further. As seen in side view in FIG. 2, each tubular member 28 has a slight incline from its top wall 24 to the rear wall 22 to facilitate flow of water 32 and sediment 34 through each member 28 or in deep water. The upper and middle sections 12 include a shelf or shoulder 36 across the width of the top wall 24, but not the bottom section 12. It should be noted that shelf 36 could also be used on the first row if needed and would not cause scouring of sand or other sediment under the unit. An illustration where this is applicable is found in FIG. 25 where the rock jetty extends beyond the lower edge of each unit. In that figure, the rock jetty extends beyond the unit preventing a backwash.

The importance of the shoulder/shelf 36 cannot be overemphasized, and the effects it has on waves and how it helps in collection additional sediment. In the upward movement of a wave, the shelf 36 shears part of the wave, breaking up the wave and dispersing of some of the energy, while redirecting some of the wave energy, thus forcing water and sediment into the tubular member. Downward movement or retreating wave, shears part of the wave, breaking up the wave and dispersing of some of the energy, while redirecting some of the wave energy, thus forcing water and sediment into the tubular member. The shelf 36 also catches any additional sediment; i.e., sediment that did not flow in the tubular member will remain trapped because of the shoulder/shelf location to the tubular opening. The next wave will wash this additional sediment through the tubular member. The shoulder/shelf location and design makes the collection of sediment more efficient.

Each shelf 36 set below the second and third rows 30 of tubular members 28, as seen in FIG. 1, would catch any sediment 34 which did not flow into the tubular members 28, and would be washed through with the next wave of water 32. Also, as seen in FIG. 3, at the rear opening 34 of each tubular member 28 there is provided a one way flapper valve 40, of the type known in the industry, which would allow the water 32 carrying sediment 34 to exit the tubular member 28, but would not allow the water 32 and sediment 34 to return into the tubular member 28, once the valving member 42 of valve 40 closes. Finally, although this will be described more fully, each section 12 is provided with an inlet valve 44 and outlet valve 46 on its top wall 24 to allow water or other substance to be pumped into and out of the interior space 26, for reasons to be explained further.

Figure 4:
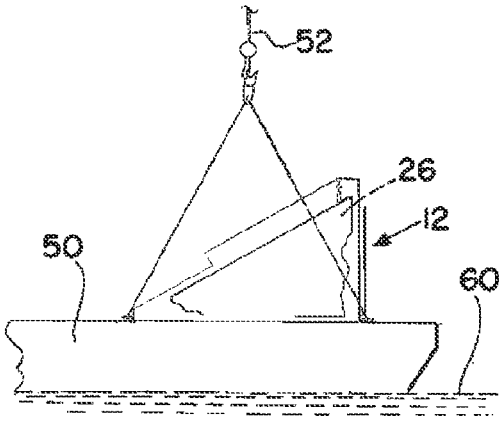
FIGS. 4 through 7 illustrate the method of installing the components of the WSSC System of the present invention.
Figure 5:
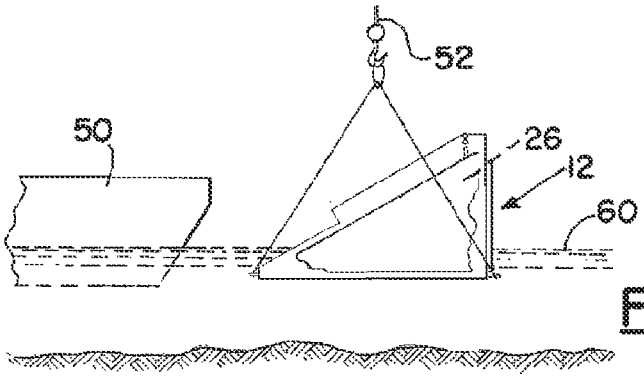
Figure 6:
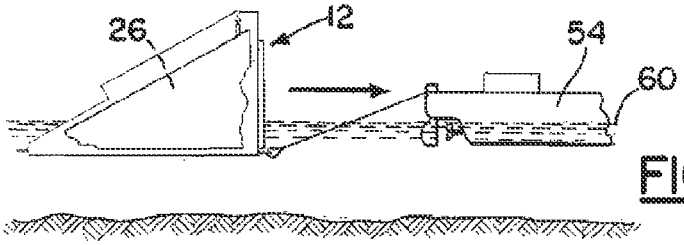
Figure 7:
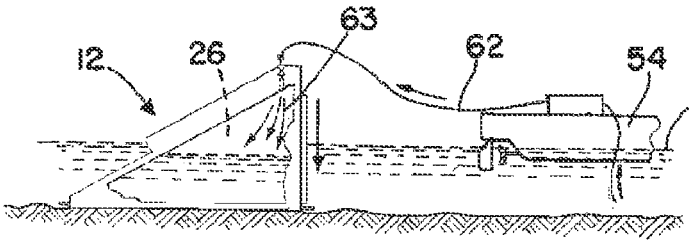

As was stated earlier, the WSSC System 10 is comprised of a plurality of sections 12 to make up the entire system along a shoreline or the like. FIGS. 4 through 7 illustrate the manner in which each section is placed on site in the body of water. In FIG. 4 there is seen a barge 50 carrying a typical section 12, as described above, the section 12 having the capability to be hoisted from the barge 50 by a crane on the barge 50. As seen in FIG. 5, the section 12 has been lifted from barge 50 by cable 52 and placed in the body of water 60, where because of the space 26 within the closed section 12, the section 12 is buoyant and able to float. Next, as seen in FIG. 6, a boat 54 would tow the section 12 to a desired point in the body of water 60. Once in place, a flow line 62 would be attached to the inlet valve 44 on section 12, and water or other fluid (arrows 63) would be pumped into the interior space 26 of a sufficient quantity in order to allow section 12 to rest on the sea floor 16. This process would be repeated for each section 12 brought on site.

Figure 8:
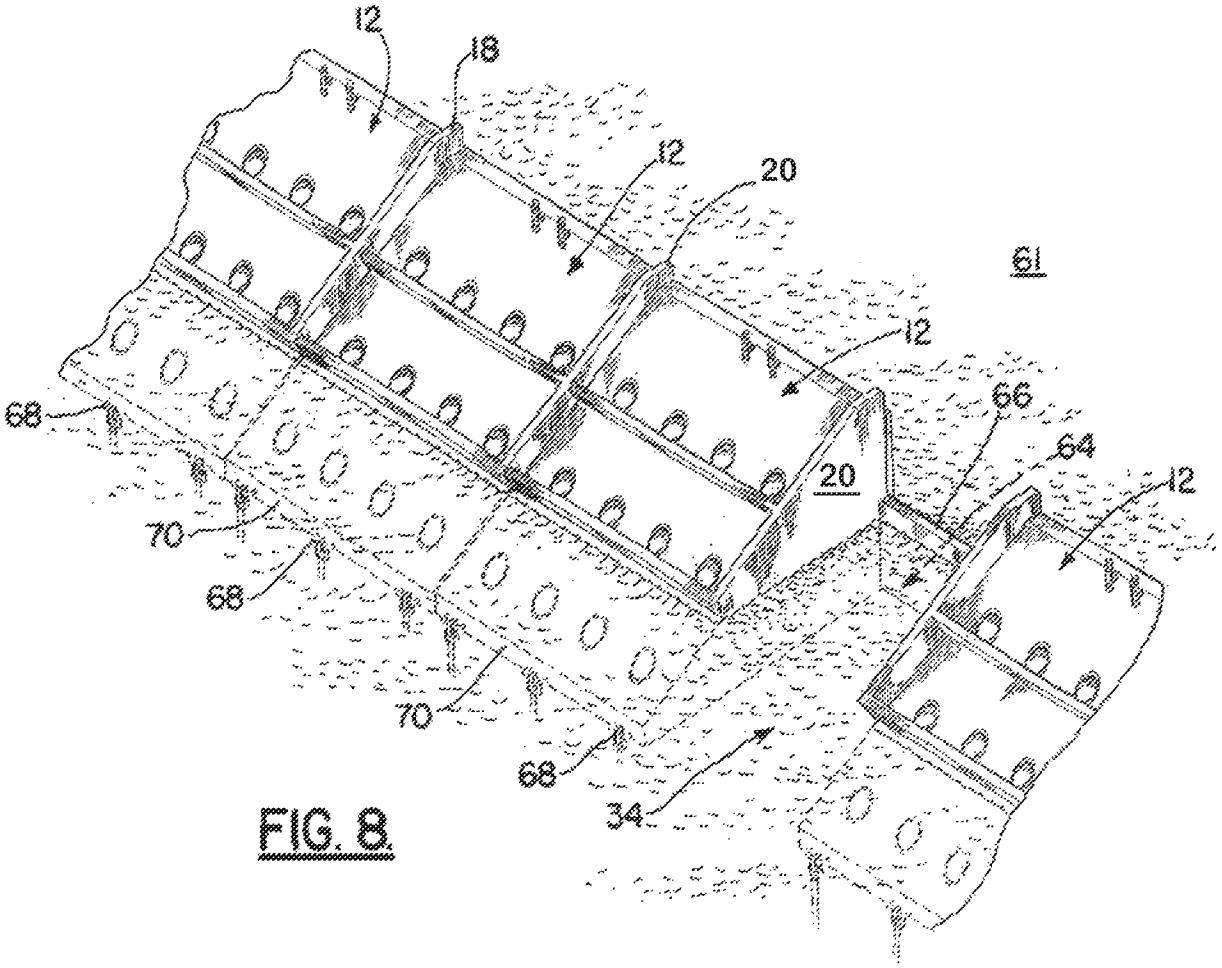
FIG. 8 is a partial overall view of a preferred embodiment of the WSSC System of the present invention being anchored in place while also illustrating water returning through the a weir between sections.

As will be described further, the multiple sections 12 would be attached to one another and anchored to the sea floor 16, as seen in FIG. 8. In this Figure, there is provided a plurality of sections 12 attached to one another along their side walls 18, 20. It should be noted that since the water 32 carrying the sediment 34 is unable to return to a point in front of the section 12, due to the action of the one way flow valve 40 as described earlier, there must be a means by which the water 32 is allowed to return to the open sea 61. FIG. 8 illustrates a flow opening 64 set at intervals between multiple sections 12, the opening 64 including a weir 66 in place, so that the water 32 is able to flow over the weir 66 and return to the open sea 61, but the weir 66 prevents sediment 34 from being carried back into the open sea 61, so that the sediment is collected between the system 10 and the shoreline.

Figure 9:
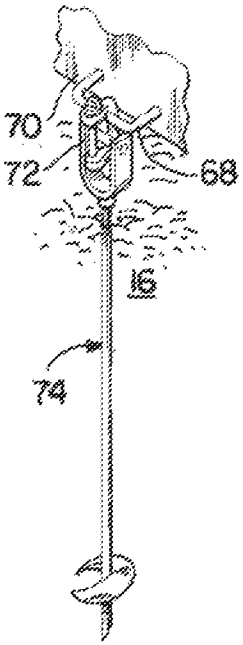
FIG. 9 illustrates a typical anchor utilized to anchor sections into the water bottom in the WSSC System of the present invention.

As seen also in FIG. 8, there is provided a system for anchoring the various sections 12 of the system 10 to the sea floor 16. As illustrated each section includes a plurality of anchor loops 68 along the front and rear bottom edges 70 of the top wall 24, which would serve to engage the top anchor portion 72 of an elongated anchoring member 74, as seen in FIG. 9, that would be bored into the sea floor 16, and once in place, as seen in FIG. 9, would be attached to each anchor loop 68, to hold each section 12 in place. As seen in FIG. 8, each section 12 would have preferably three anchor loops 68 along its front edge, and three along its rear edge, each loop secured to the top anchor portion 72 of three members 74.

Figure 10:
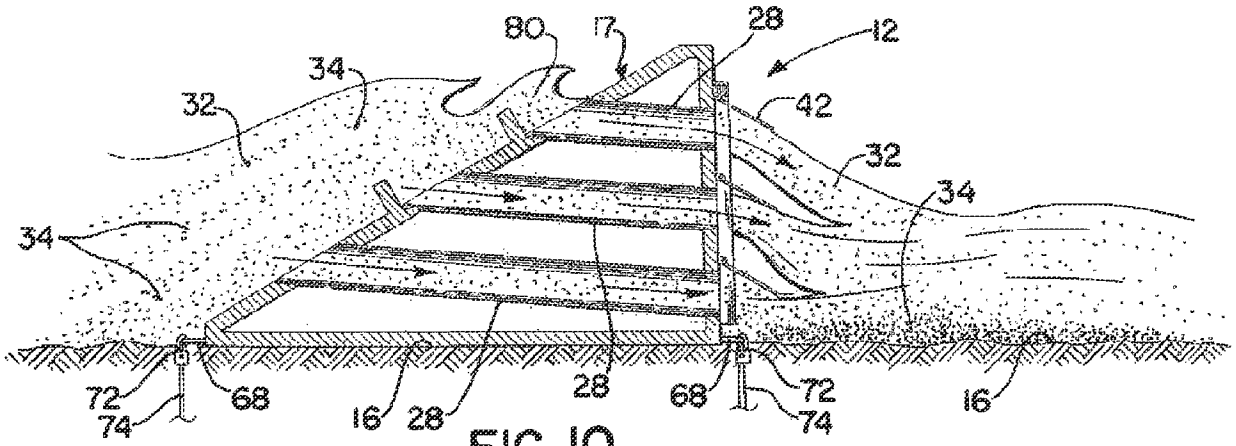
FIG. 10 is another side cutaway of a preferred embodiment of the WSSC System of the present invention illustrating water carrying sediment through the system.

FIGS. 10 and 11 illustrate the manner in which the system 10 operates to suppress wave action while at the same time collecting sediment to the rear of the system 10. Periodic waves going over the units or sections are not necessarily harmful; these waves carry larger volumes of sediment meaning more sediment will be collected and recovered. As illustrated first in side cutaway view in FIG. 10, each section 12 while resting on the sea floor 16, the upper part 17 of the triangular shaped section 12, as seen in side view, is extending out of the water. This feature is important, since by extending out of the water, it will serve as a partial barrier or will serve to suppress the action of the wave 80 as the wave 80 flows by the system 10, which would be beneficial to the coast line by reducing or eliminating erosion of precious coast line.

While the system 10 is serving that function, its second and equally important function is also illustrated in FIGS. 10 and 11. As illustrated the water 32 in wave 80 crosses the system 10, the water 32 is carrying a certain quantity of sediment 34 stirred up from the sea floor 16. The water 32 and sediment 34 flow through the plurality of tubular members 28 and sediment is deposited to the area 84 of the sea to the rear of the system 10. As the waves 80 continue to flow over and through the system 10, more and more sediment 34 is collected in the area 84, and the water flows back to the sea through openings 64 formed in the system 10. As seen in FIG. 11, the sediment 34 has collected to a height where the lowermost tubular members 28 are completed blocked by the build up of sediment 34. This buildup may continue until the sediment 34 builds higher to a point where the flow through the members 28 could be completely blocked. This would be the point at which the system 10 would need to be moved further out from the shoreline if so desired.

This would be accomplished by removing the top anchor portions 72 from each section, placing the flow line 62 onto the outlet valve 46 on each section 12, and pumping the fluid out of the interior 26 of each section 12. The section 12 would become buoyant once more, and the reverse steps would be taken as seen in FIGS. 4 through 7. The boat 54 would tow each section 12, where a cable would be attached to the section 12, which would then be lifted onto a barge 50 and floated to the next destination. If the destination were close by, the boat 54 could simply tow the section 12 to the location without having to lift the section 12 onto a barge 50. Then steps 4 through 7 would be repeated in placing each section 12 at its new location, where together the sections 12 would form a new system 10 within the body of water.

Following the discussion of the manner in which the system 10 operates, reference is made to FIG. 12A, where an entire system 10 has been anchored in place to the sea floor 16 and along a shoreline 15, with both ends 11 of the system 10 anchored to the shoreline 15, to encompass a certain area of a bay or water inlet. In FIG. 12A, the system 10, in its operation, as will be described below, is seen with the plurality of sections 12, secured side by side, with openings 64 placed between multiple sections 12, to allow the tide to return to the sea, through the openings 64, and each opening 64 having a weir 66 in place to stop sediment 34 to return to the open sea. So, in effect, the system 10, is operating to collect sediment 34 in the water between the system 10 and the shoreline 15, while at the same time suppressing the wave action which damages the coastline. It should be made clear that the system 10, for example, as seen in FIG. 12A, could be arranged in a different configuration other than a straight line, side by side, so as to take advantage of currents as well as wave actions in a particular body of water.

Figure 12B:
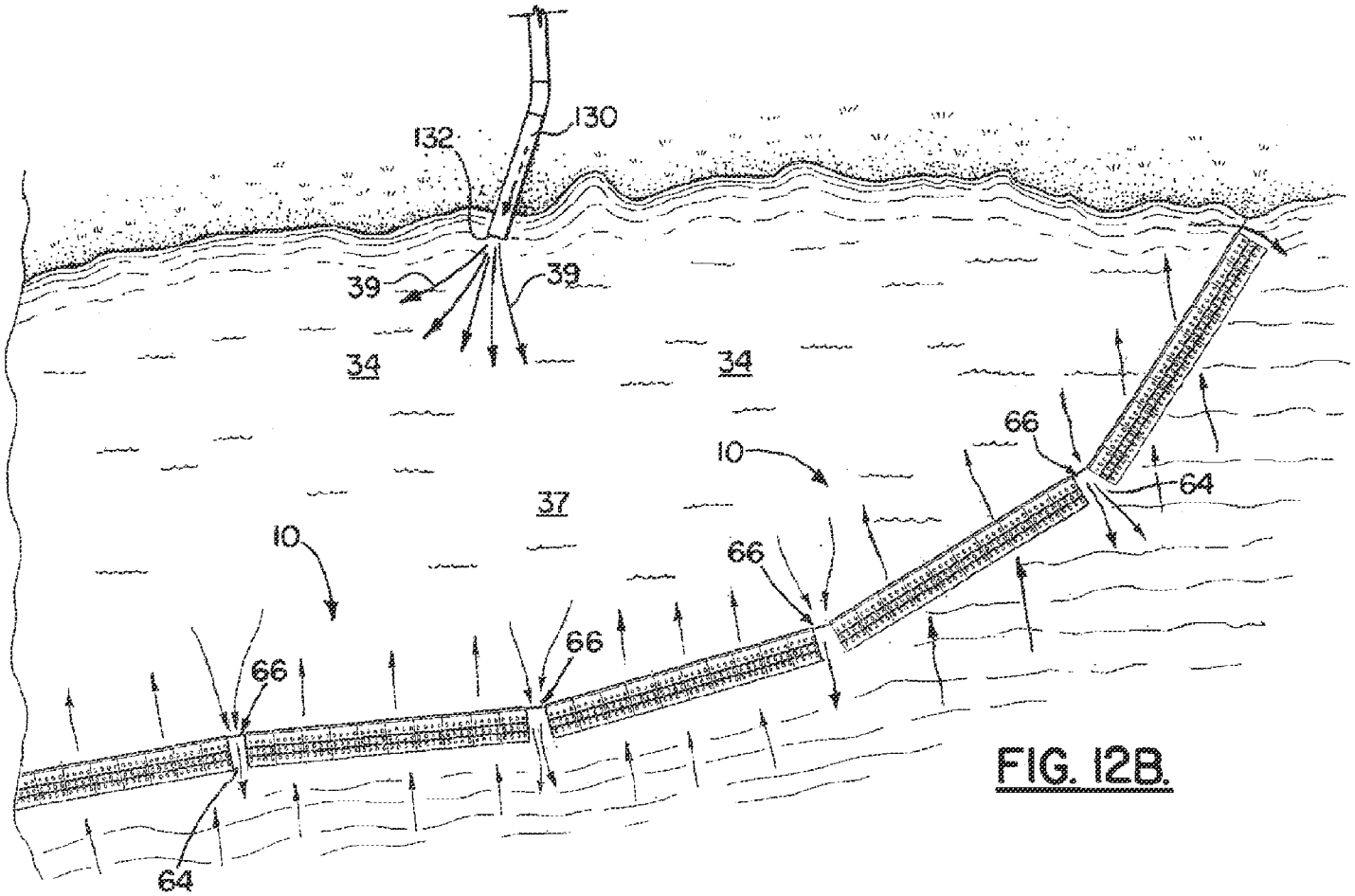
FIG. 12B is an aerial view of the WSSC System in place along a shoreline in a body of water with sediment being pumped in via a pipe from the shore.
Figure 13:
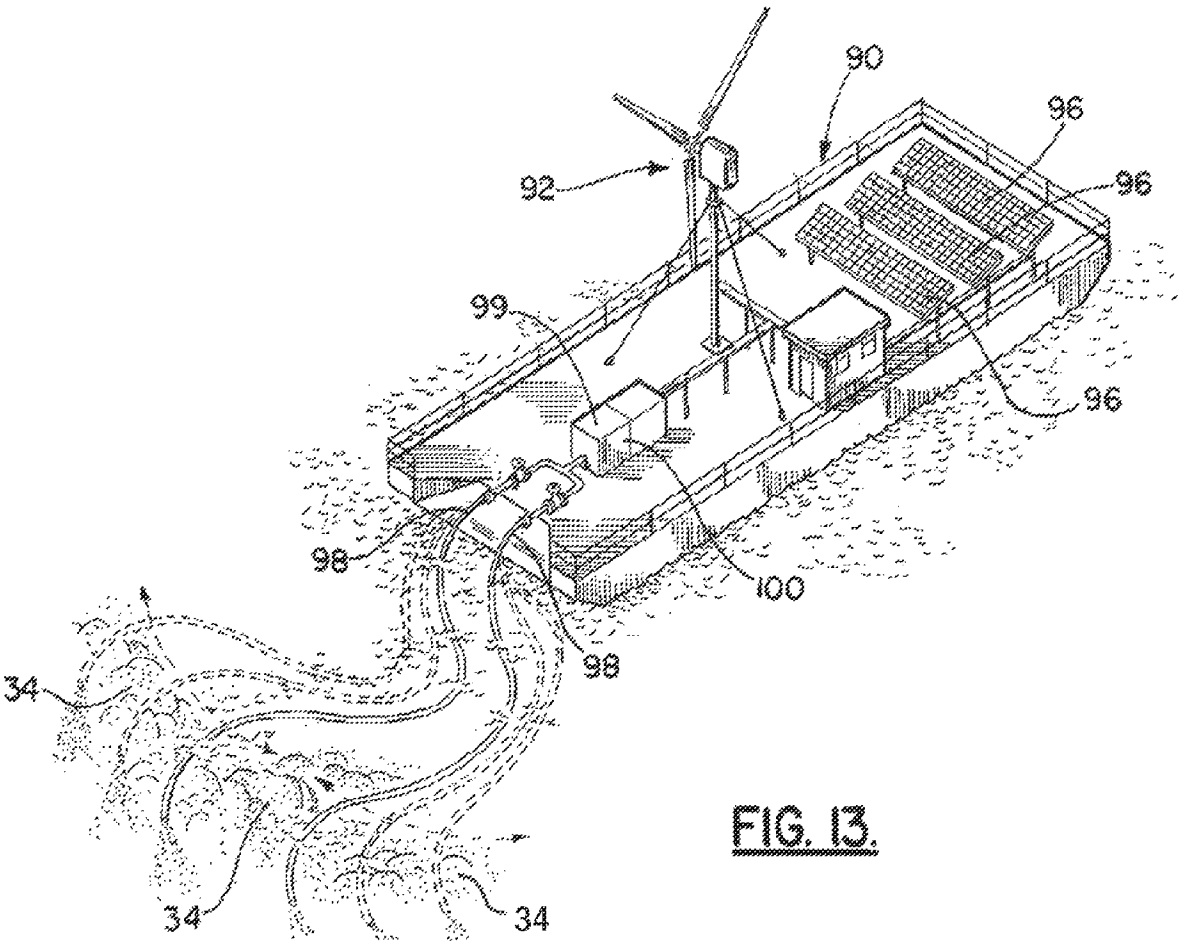
FIG. 13 is an overall view of a system utilized to stir up sediment to be carried by the water through the WSSC System of the present invention.
Figure 15:
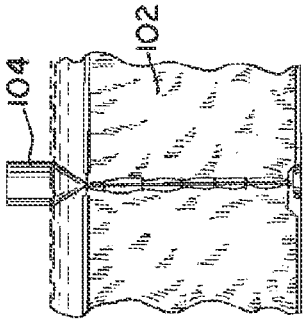
FIG. 15 is a view along lines 15-15 in FIG. 14, which illustrates one of the buoys used to support the net surrounding the sediment stirring system illustrated in FIG. 13.

Another feature of the system's operation is seen in FIG. 12B. As seen in this figure, the system 10 is in place as described in FIG. 12A. However, here there is a pipe 130 which is delivering sediment 34 being pumped from a location inland and flowing from the end 132 of pipe 130 into the bay or inlet, as seen by arrows 39. With the system 10 in place, the sediment is captured within the confines of the system 10, within area 37, and will not escape, although water flow will continue through the spaces 64 where the weirs 66 are in place. Therefore, not only is sediment 34 being deposited from the normal wave action of the sea, but also additional sediment 34 is being pumped in and kept in place by the barrier formed by system 10.

Returning now to the system 10, as was stated earlier, a most important aspect of this system 10 is the collection of sediment 34 to help rebuild an eroded coastline or other sea area. To facilitate that function, further, reference is made to FIGS. 13 through 15. In these figures, there is seen a system for providing a greater quantity of buoyant sediment 34 in the water which will be flowing through the system toward the coastline. As illustrated first in FIG. 13, there is provided a specially equipped barge 90 which would include components that would be powered by wind and solar power. There is provided a windmill 92 on the barge which would be of the type to provide power to be stored in batteries for powering equipment on the barge 90. There would also be provided a bank of solar panels 96, again to supply a source of power to be stored in batteries for powering equipment on the barge. The barge 90 would include generators which would power air compressors 99 for compressing air into storage tanks 100. The storage tanks 100 would have a plurality of air lines 98 extending from the barge 90 to the sea floor 16. There would be an automatic system for releasing the compressed air from the tanks 100 through the lines 98 to exit at nozzles at the end of the lines 98. The compressed air being released would stir up the sediment 34 on the sea bed 16, which would allow the waves 80 to carry a great quantity of additional sediment 34 through the system 10 to be deposited at an even greater rate. Since the barge system is automatic, the flow of air would be triggered by timers or the like, and would be shut off so that the air compressors 99 could re-fill the tanks 100 with compressed air. The barge 90, of course, could change locations as needed for the system 10 to gain maximum use of the flow of additional sediment 34 through the system 10.

Figure 14:
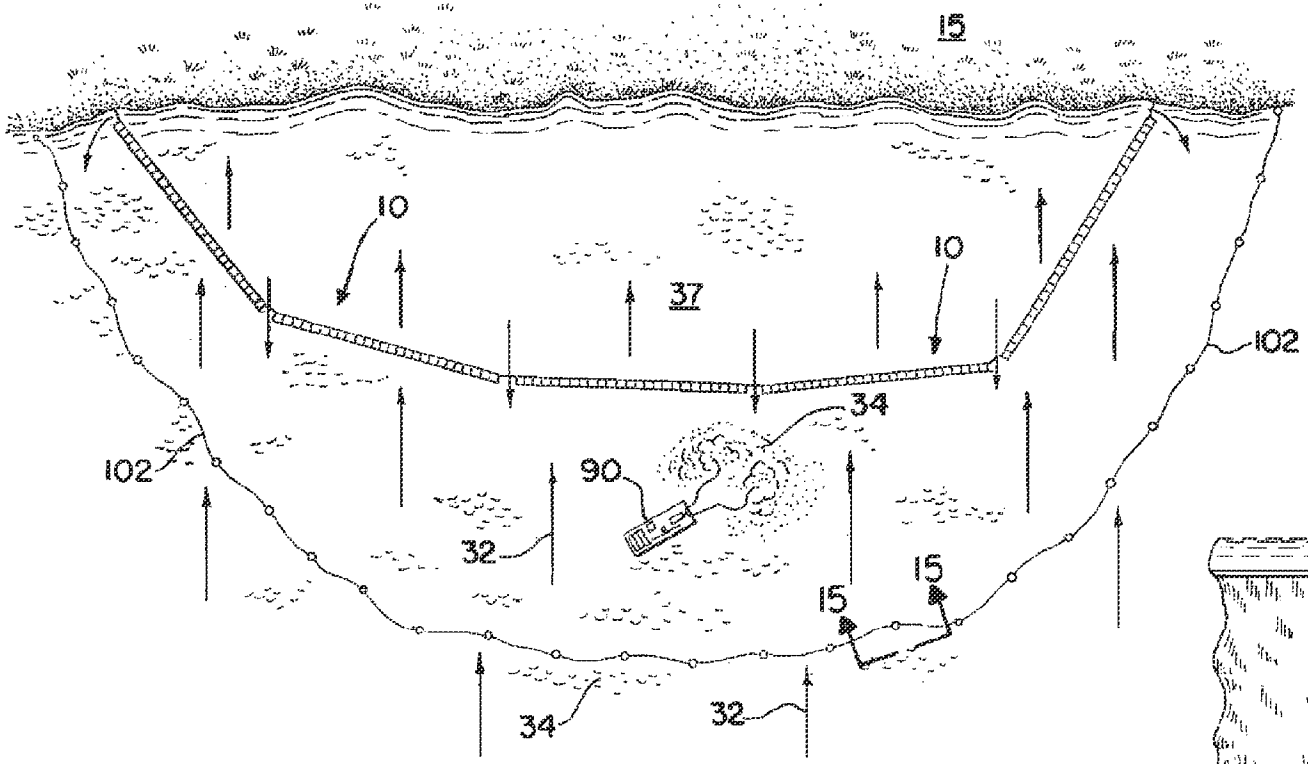
FIG. 14 is an aerial view of the sediment being stirred up by the system described in FIG. 13.

FIG. 14 illustrates an aerial view of the system 10 using the specially equipped barge 90 in inducing the flow of additional sediment 34. As illustrated, while the barge 90 is being used, there would be provided a net 102 in place around the outer perimeter of the system 10, with the net 102 held in place by a plurality of spaced apart anchored buoys 104, of the type illustrated in FIG. 15, so that water 32 and sediment 34 flow through the net 102, but sea life is prevented from moving into the area where it could be injured or killed by the air flow lines operating on the floor 16 of the sea. It should be made clear that in place of net 102 there could be provided a sediment barrier set in place, of the type commercially available in the art.

Figure 16:
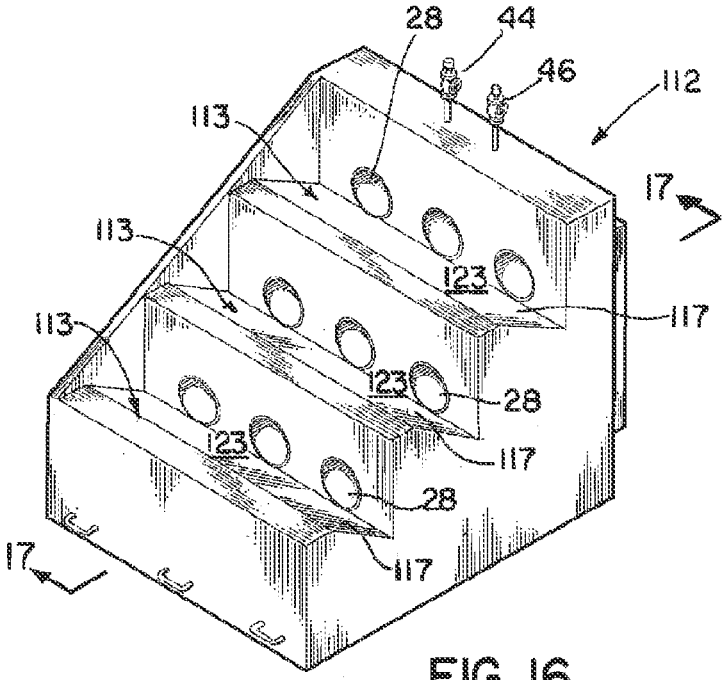
FIG. 16 is an overall view of an alternative embodiment of a section used in the WSSC System of the present invention.
Figure 17:
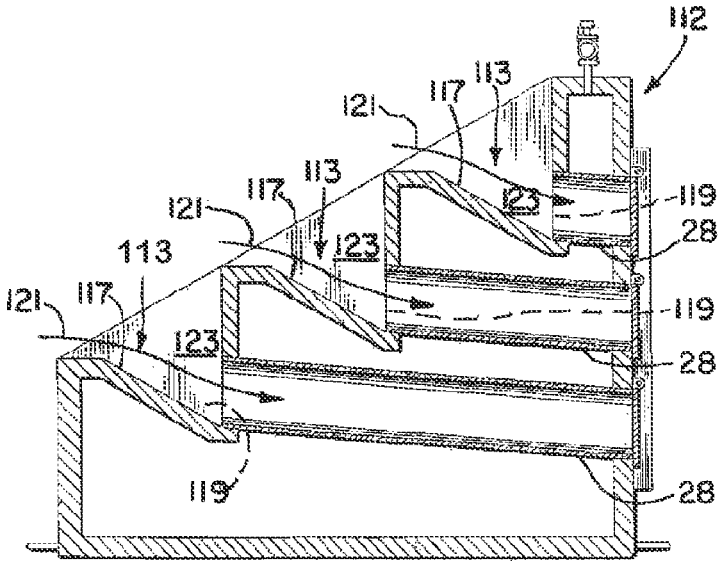
FIG. 17 is a side cutaway view of an alternative embodiment of a section taken along lines 17-17 in FIG. 16.

While the system 10 as described above is very capable of achieving the ends desired, it is foreseen that each section 12 may be configured slightly different than that as illustrated in FIGS. 1 through 3. Reference is made to FIGS. 16 and 17, where there is illustrated a section 112, where the top wall 26 of the section 112 has been changed from the flat top wall 26 of section 12 as seen in FIG. 1, to a series of steps 113, where the floor 117 of each step 113 would be slanted down to the entry 119 of each tubular member 28. Therefore, as water 32 and sediment 34 would wash across each section 112, the water 32 and sediment 34 would flow down along the floor 117 of each step 113, in the direction of arrows 121, so that the area 123 at the entrance of each tubular member 28 would serve as a collection area for sediment 34, until the sediment 34 is carried into and through the tubular members 28 by the next wave or tidal action. This configuration would provide greater assurance that the maximum amount of sediment 34 is being captured at the front of the section 112, so that it can be moved through the members 28 to the rear of the section 112 for greater building of sediment were desired.

Figure 19:
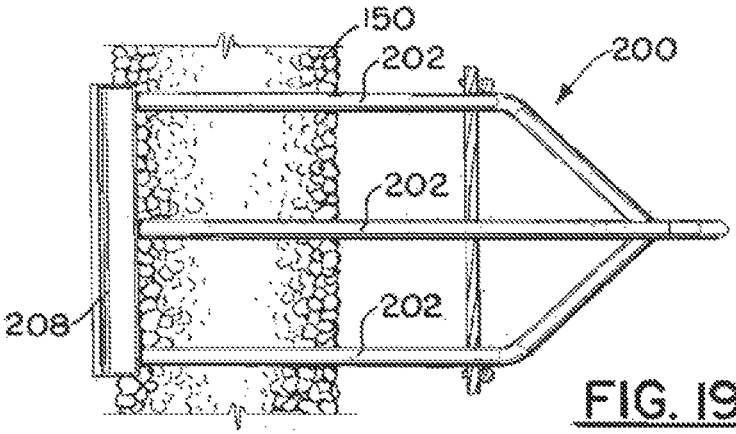
Figure 20:
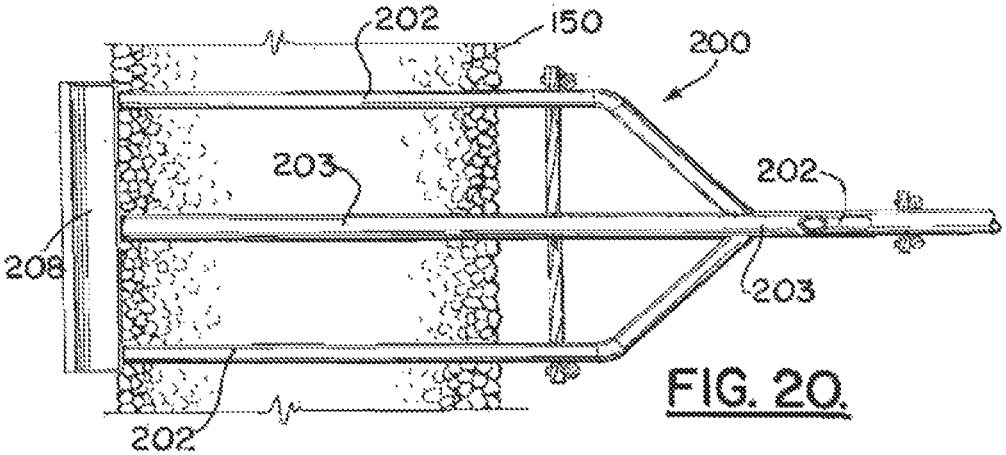
Figure 21:
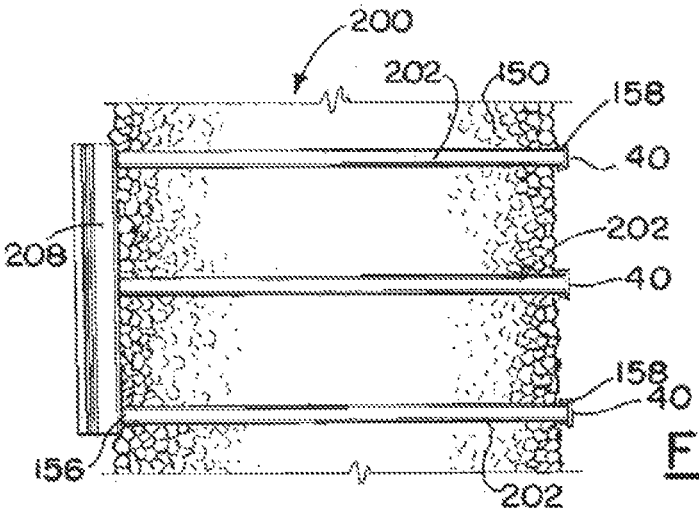
Figure 22:
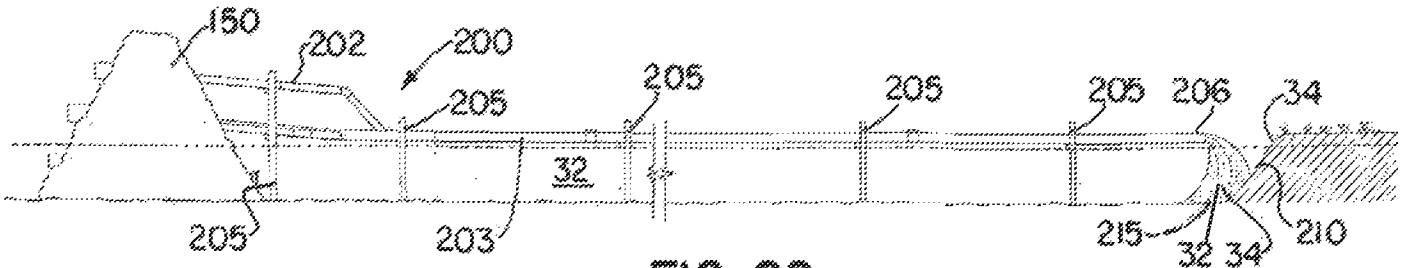
Figure 23:
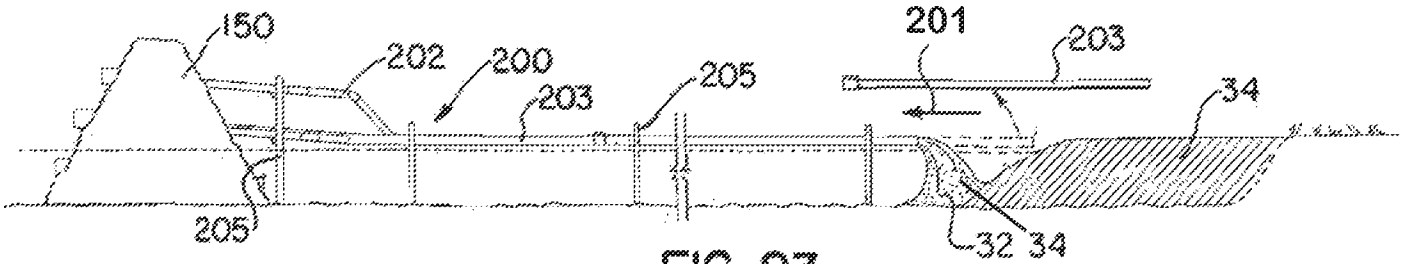
Figure 24:
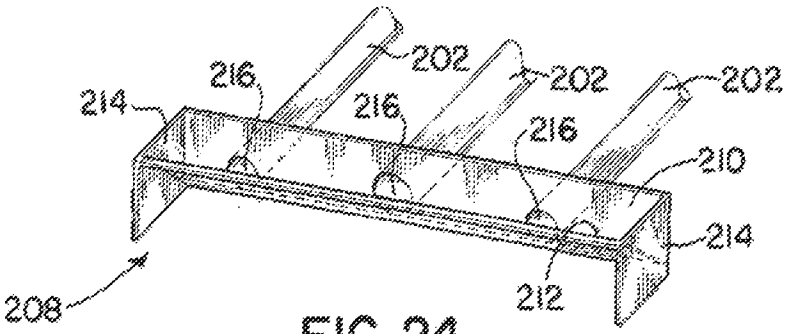

Reference is now made to FIGS. 18 through 24, where a first embodiment of the WSSC System, labeled System 200 is incorporated into a rock jetty 150, of the type which has been constructed to block the entrance to the waterway referred to as Mr. Go in south Louisiana. As illustrated in top views in FIGS. 19 through 21, there is provided a rock jetty 150 into which the system 200 is incorporated. In FIG. 21, taken along lines 21-21 in FIG. 18, it is foreseen that the base 152 of the jetty 150 would be laid in place, and then a plurality of elongated pipes 202 would extend from the forward point 156 of jetty 150, in this case three pipe sections 202 to the rear point 158 of rock jetty 150. At the forward point 156, the three pipes 202 would extend from a trough 208, as illustrated in FIG. 24, having an upright rear wall 210, a angulated floor 212, and a pair of side walls 214, so that the trough 208 would serve to capture the flow or water 32 carrying sediment 34, and the angulated floor 212 would direct the water and sediment into the entrance 216 to the pipes 202 more efficiently, to be carried to the rear of the jetty 150. The pipe sections 202 in this lower level of pipes 202 would terminate and dump water 32 and sediment 34 to the rear of the jetty 150, and each pipe would be equipped with a flapper valve 40 to maintain the sediment 34 in place.

Figure 18:
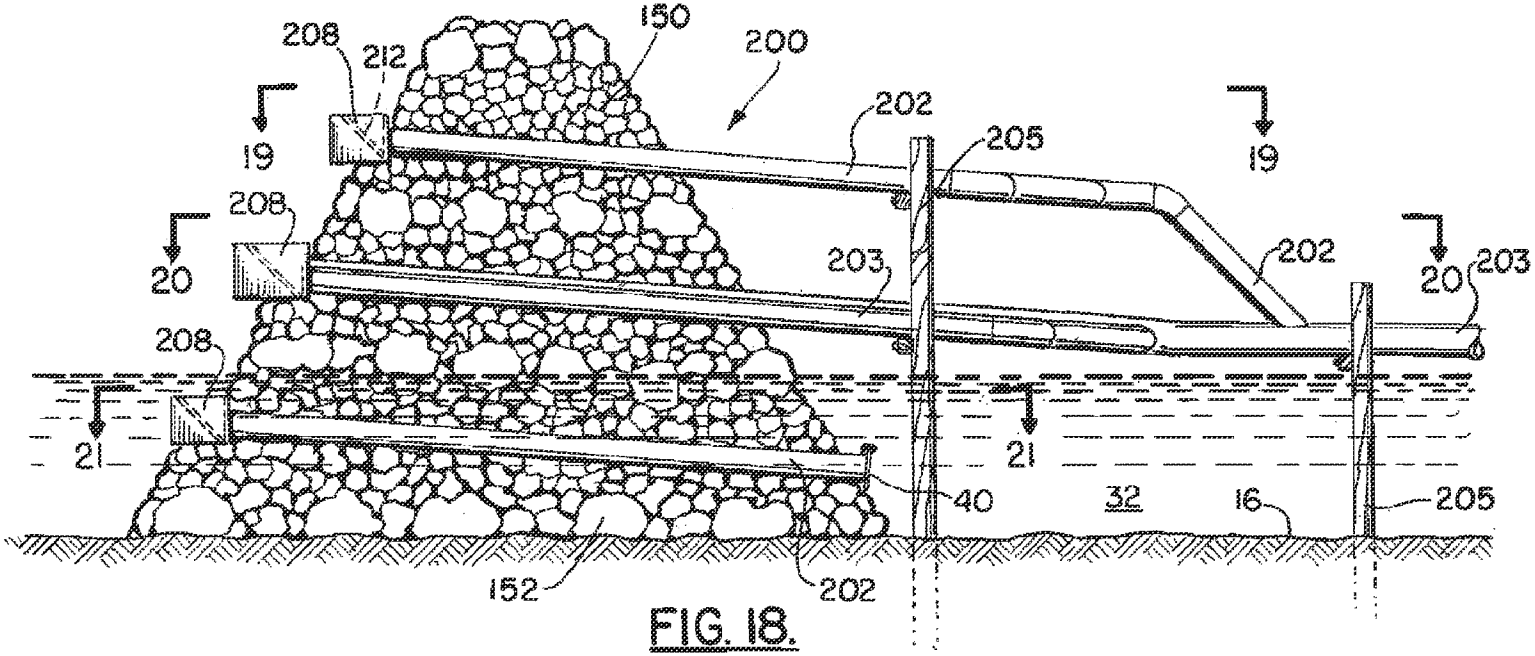
FIGS. 18 through 24 illustrate the principal embodiment of the WSSC System of the present invention as it would be installed to function positioned through a rock jetty.

FIG. 20 illustrates the second level of pipes as shown along lines 20-20 in FIG. 18. This second or middle level of pipes 202 would capture water 32 and sediment 34 in the same manner as described in FIG. 21, but in this case, the pipes 202 would all converge and empty into a principal flow pipe 203, somewhat larger in diameter, to carry the water and sediment further to the rear of jetty 150, as will be described further.

FIG. 19 illustrates the three pipes 202 at the upper most level in jetty 150, as seen along lines 19-19 in FIG. 18. This group of pipes 202 would also collect water 32 and sediment 34 in the same manner as the lower and middle sections. However, because the upper section of pipes 202 are positioned higher, the pipes 202 would be diverted downward, as seen in FIG. 18, to dump into the principal flow pipe 203 to be carried rearward.

In FIGS. 22-23 there is illustrated WSSC System 200 in side view where the principal pipe 203, as described earlier, is extending rearward to a predetermined distance, and is supported in its path by a plurality of upright piers or pilings 205, until the rear end 206 of the pipe reaches its destination. In this embodiment, the pipe 203 is carrying water 32 and sediment 34 to a point 215 where sediment 34 has been deposited earlier. Therefore, additional sediment 34 will be dumped so as to continue to build up sediment in the direction of arrow 201. As seen in FIG. 23, once the pipe 203 has deposited sediment at its end to the height desired, a section of principal flow pipe 203 is removed, and the sediment 34 will continue to dump sediment 34 so that the sediment buildup continues to fill the gap between the furthest point from the jetty 150, until theoretically, sediment 34 is built up to the base of jetty 150. Since in the case of the waterway Mr. Go, not only would the waterway be closed via the rock jetty 150, but with this system 200 in place, the entire body of water between the jetty 150 and the far end of the Mr. Go waterway, could be filled with sediment 150, simply through the constant wave action of the sea. The result is the rebuilding of valuable coastline which has been eroded away in the past.

Figure 25:
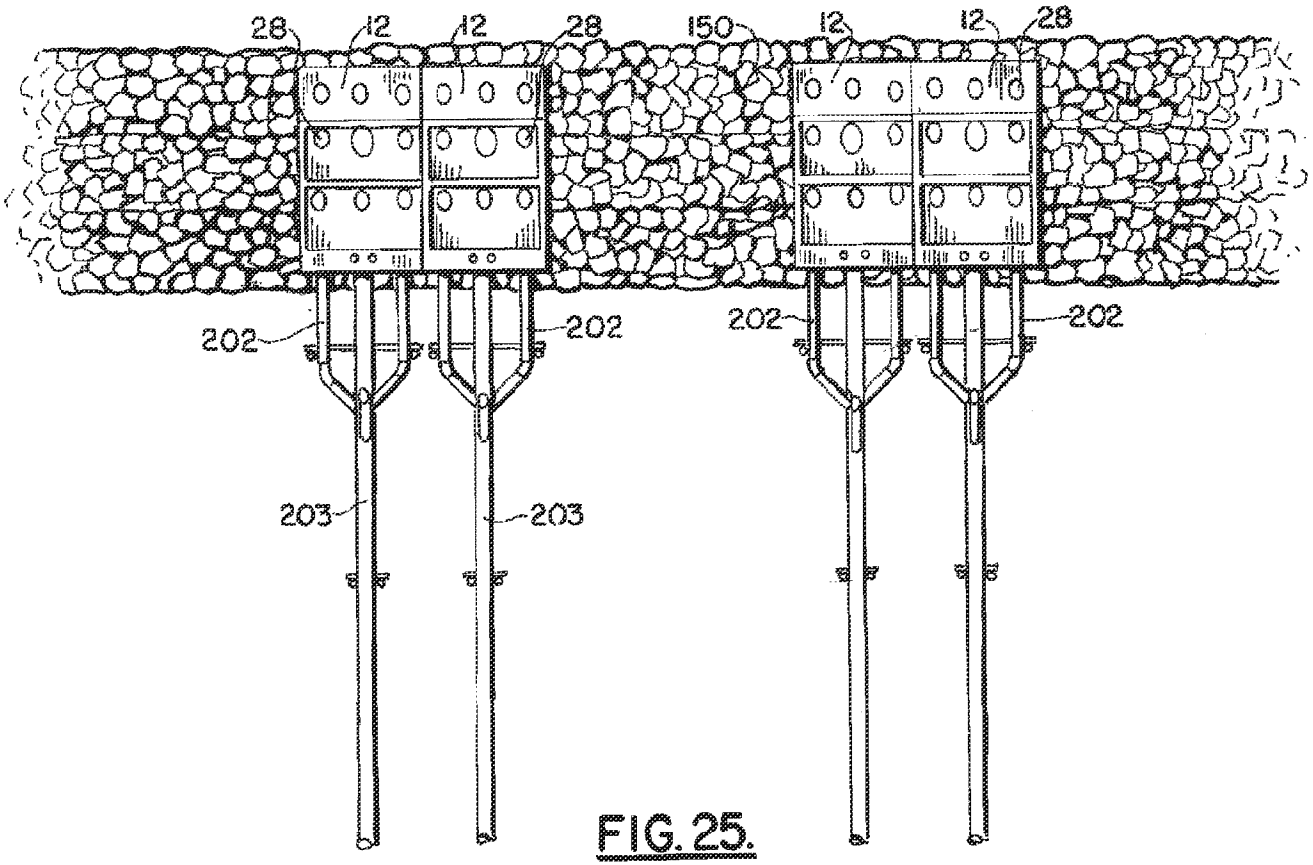
FIG. 25 illustrates a second embodiment of the WSSC System as it would be installed within a rock jetty.

Although FIGS. 18 through 24 illustrate a preferred embodiment for establishing the WSSC System through a rock jetty 150, it is foreseen that the WSSC System 10 as described in FIGS. 1 through 17 could be placed within a rock jetty 150, as seen in FIG. 25. When the system 10 is placed within a rock jetty it may be required that the system is anchored in place so that the strong storm currents won't dislodge the units. An additional shoulder/shelf 36 could be used in this configuration because it would not cause a backwash below the base of the rock jetty. The base of the rock jetty protrudes beyond the base of the unit preventing the backwash from developing. Rather than the water 32 entering the trough 208, there would be provided a plurality of sections 12, as previously described, for receiving the water 32 and sediment 34 into flow pipes 28, and the rear end of each section 12, rather than having a valve 40, the water 32 carrying sediment 34 would flow into flow pipes 202, which would then flow into principal pipe 203, and the system would operate in the manner as described in FIGS. 18 through 24. Although FIG. 25 illustrates the units set up in pairs which are spaced apart, it is foreseen that a plurality of two or more units in a group could be set along the rock jetty.

In the principal embodiment of the system 10, as described in FIGS. 1 through 17, it is foreseen that each section is constructed of a buoyant type material, such as rubber from old tires; that each section would be approximately 12 feet (3.7 m) long and 12 feet (3.7 m) wide, with the rear wall approximately 6 feet (1.8 m) at its highest point, and the front wall angulated to be around 13.5 feet (4.11 m) in length. The pipes would be preferably PVC material, and would be around 1 foot (0.3 m) in diameter.

Reference is now made to FIGS. 26A-33C, which illustrate the second embodiment of the WSSC System as it would be installed through a rock jetty 150 and will be illustrated as WSSC System 300.

Figures 26A, 26B, 27, 28:
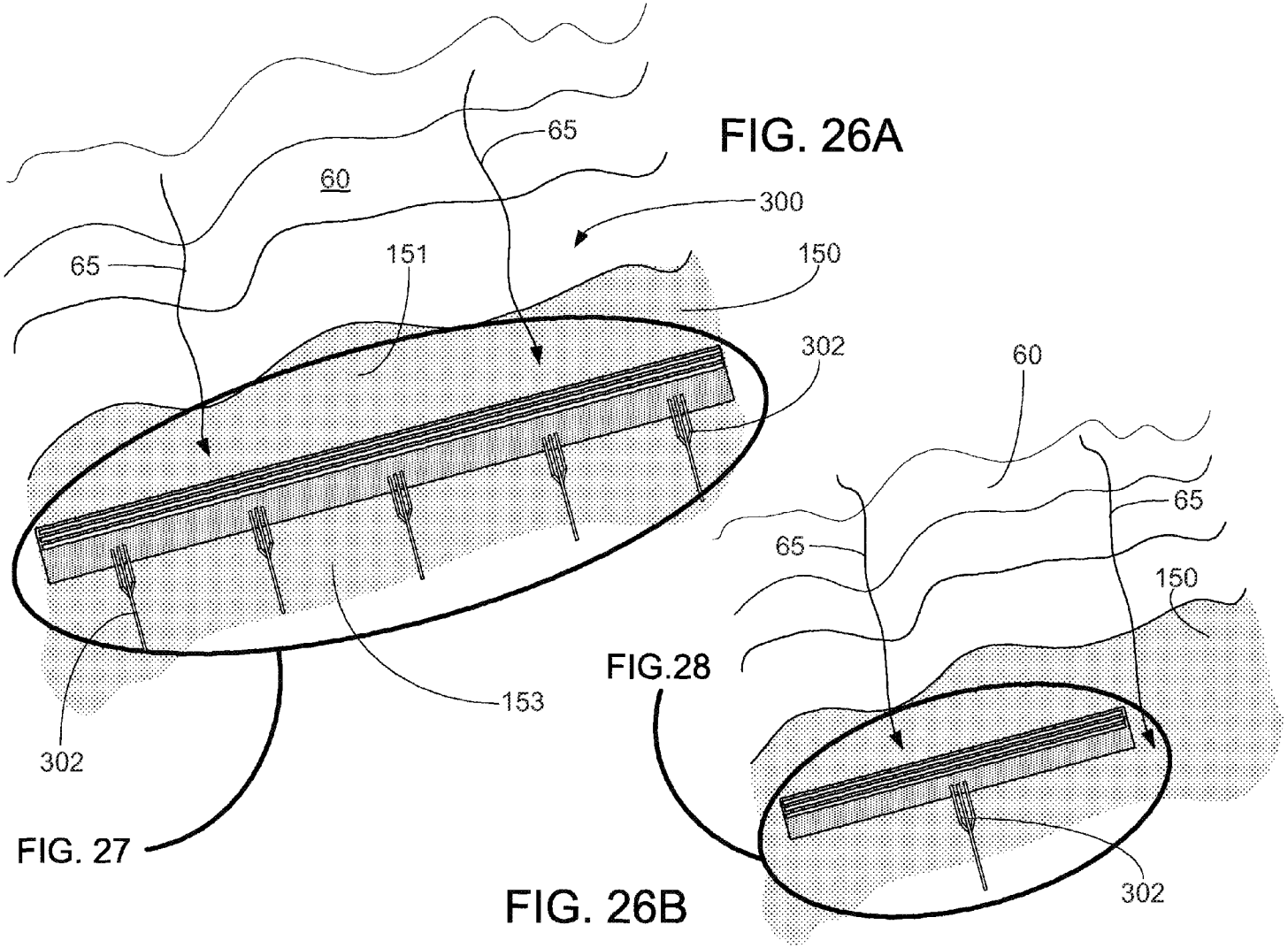
FIGS. 26A and 26B illustrate overall top views yet an additional embodiment of the WSSC System as it would be installed within a rock jetty.
FIG. 27 illustrates isolated top views of two components of the WSSC System as illustrated in FIGS. 26A and 26B.
FIG. 28 illustrates an isolated to view of a single component of the WSSC System of the present invention.
Figure 27:
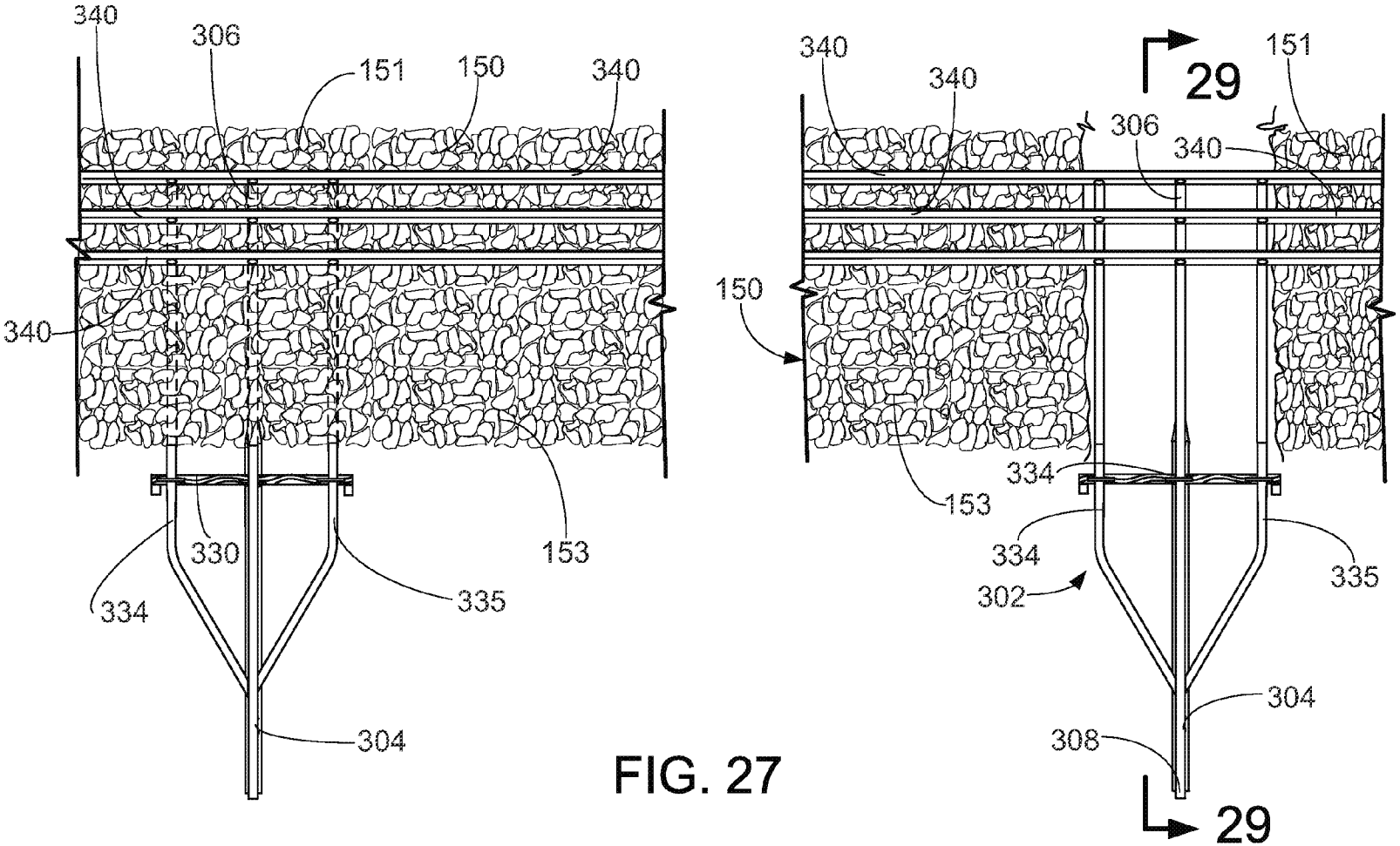
Figure 28:
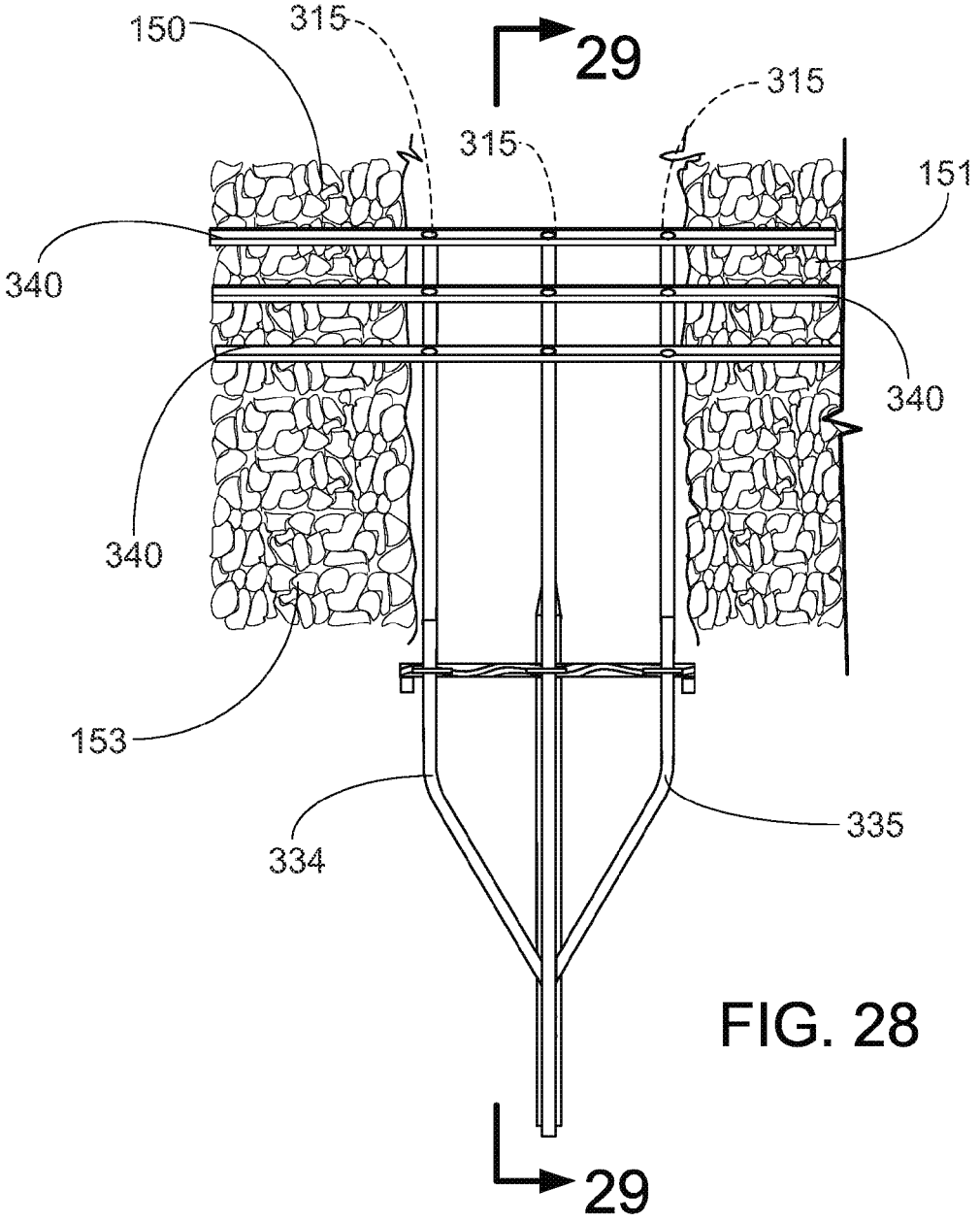

Turning now to FIGS. 26A and 26B, there is illustrated a body of water 60 having a current illustrated by arrows 65, flowing towards a rock jetty 150 as illustrated. In FIG. 27 there is a plurality of sediment collection components 302, which will be described below, positioned through the rock jetty 150 for the reasons as will be described further. As illustrated more clearly in FIG. 27, there is provided a single sediment collection component 302, extending through a rock jetty 150. The principal function of each of the components 302 is to receive water and sediment through the component 302 from the unprotected side 151 of the jetty 150 to the protected side 153 of the jetty 150 in order to enable sediment to be carried through the components 302 from the unprotected side 151 of the jetty 150, to the protected side 153, so that the sediment can form dry land up on the protected side 153 of the jetty 150. As illustrated in top view in FIG. 27, the component 302 includes the principal flow pipe 304 having a first sediment receiving end 306 extending out of the unprotected side 151 of the jetty 150, and a second outflow point 308 extending a distance outward from the protected side 153 of the jetty 150.

Figure 29:
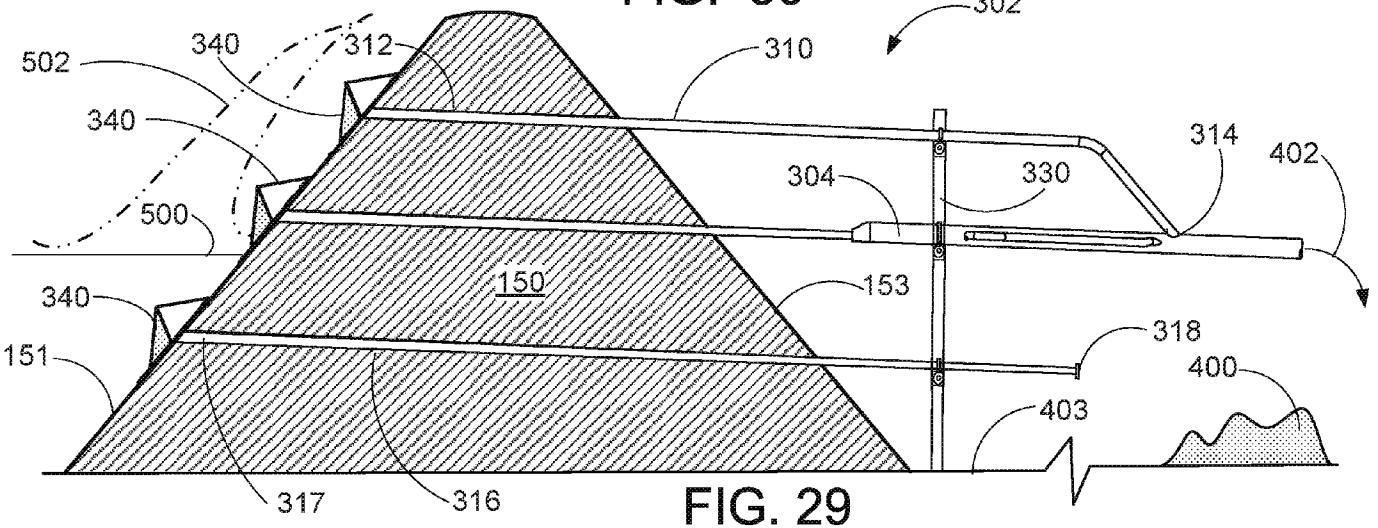
FIG. 29 illustrates a cross-section view of the WSSC System along lines 29-29 in FIGS. 27 and 28.

It should be known that FIG. 27 should be viewed in conjunction with FIG. 29 which illustrates a side view of the component 302. In the side view, it is noted that the principal pipe 304 has an upper sediment receiving pipe 310 with a first end 312 extending from the unprotected side 151 of the jetty 150, and extending through the rock jetty 150 and terminating at a second end 314, which connects into the wall of the principal pipe 304 on the protected side 153 of the jetty 150. Additionally, as seen in FIG. 29, there is seen a lower level pipe 316 with a first end 317 extending into the jetty 150 and terminating at a second end 318 a distance from the protected side 153 of the jetty 150. It should be noted that lower pipe 316 does not flow into principal pipe 304, since to do so would be flowing against gravity, which is not beneficial. The principal pipe 304, upper flow pipe 310 and lower flow pipe 316, as illustrated, are all supported on the protected side 153 of the jetty 150 by a support structure 330, so that the pipes are maintained at a slight angle extending from the sediment collection points on the unprotected side 151 of the jetty 150 downward at an angle to the protected side 153 of the jetty 150, so that the sediment and water drains through the various collection pipes and is deposited at an outflow point 308 of the collection pipe system 300. As shown in FIG. 29, sediment 400 will be deposited in the direction of arrow 402 onto dry land 403.

Figure 30:
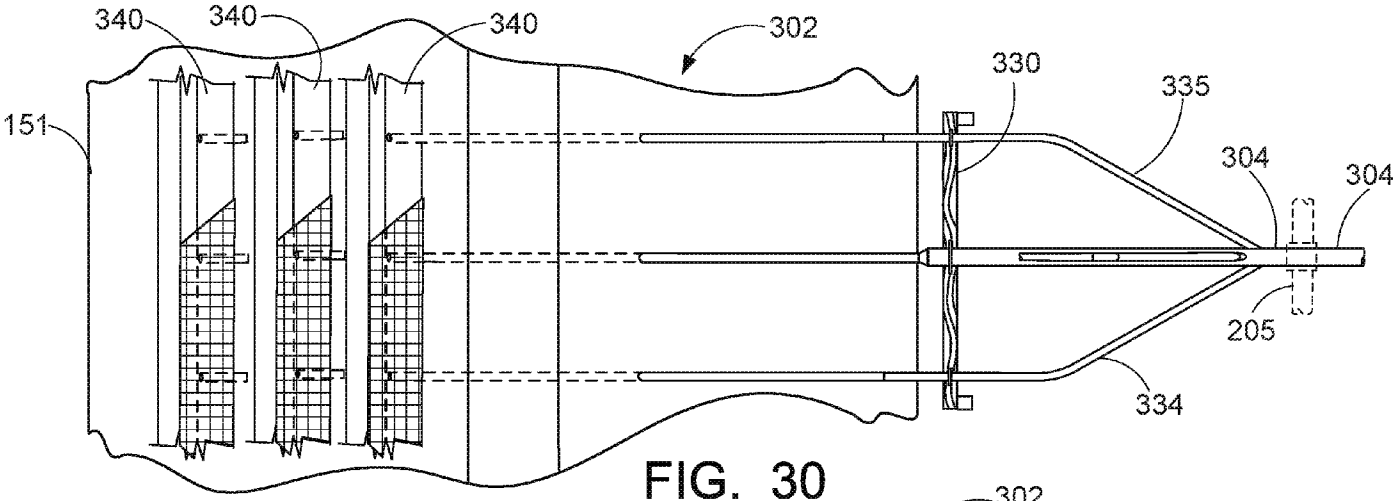
FIG. 30 illustrates a top view of the drainage component of the WSSC System installed within a rock jetty and terminating on its end in a continuous trough for receiving the water and sediment flow into the drainage component.

Turning now to FIG. 30, there is illustrated a top view of the component 302 which includes a pair of side drain pipes 334, 335, extending from the unprotected side 151 of the jetty 150 at the same level as the principal drain pipe 304, and flowing into the principal drain pipe 304 at a point past the protected side 153 of the jetty, so that as illustrated, only the principal flow pipe 304 deposits the sediment 400 at the outflow point 308, together with the lower flow pipe 316, as explained earlier.

An interesting facet of this embodiment of the collection system 300 is the means in which the sediment and water is allowed to flow into the various collection pipes 304, 310, 316, 334 and 335 of each component 302. As seen first in FIGS. 31-33C, the upper collection pipe 310 terminates with an upper opening 315 on the unprotected side 151 of the jetty 150, principal collection pipe 304 and side pipes 334, 335 terminate at openings at a lower point outside the jetty 150, and the lower collection pipe 316 terminates at the lowest point outside the jetty 150, all in order to collect the sediment 400 being carried by water. At each of these three levels of pipe openings 315 of the collection pipes, there is provided a sediment collection component, which will be defined as a collection trough 340, which would be a continuous trough along the length of the jetty where the collection system 300 is placed. Each trough 340, as seen in side view in FIGS. 31 and 32A and 32B, would comprise a flat surface 343, secured into the rock jetty 150 via mounting pins 344 driven into the face of the jetty 150. There is provided a triangular trough portion 340 having a face secured to the jetty 150, and lower support wall 345 extending upward at an angle, and supporting the floor 347 of the trough 340, with the floor 347 angulated toward the opening 315 in each collection pipe so that water and sediment 400 flowing in the direction of arrow 350 would engage the floor portion 347 of the trough 340, and would force gravity flow into the pipe opening 315 in the direction of arrows 350. Further, there is provided an upper filter screen 354 which extends throughout the length of the collection system trough 340, so that any large debris or any rocks falling off the rock jetty would not fall into the collection area 357 of the trough 340 which collects the water and sediment for flowing into the various pipes. Therefore, this would provide a means for preventing any clogging up of the trough 340 into which the water and sediment is collected during the collection process.

Figure 34:
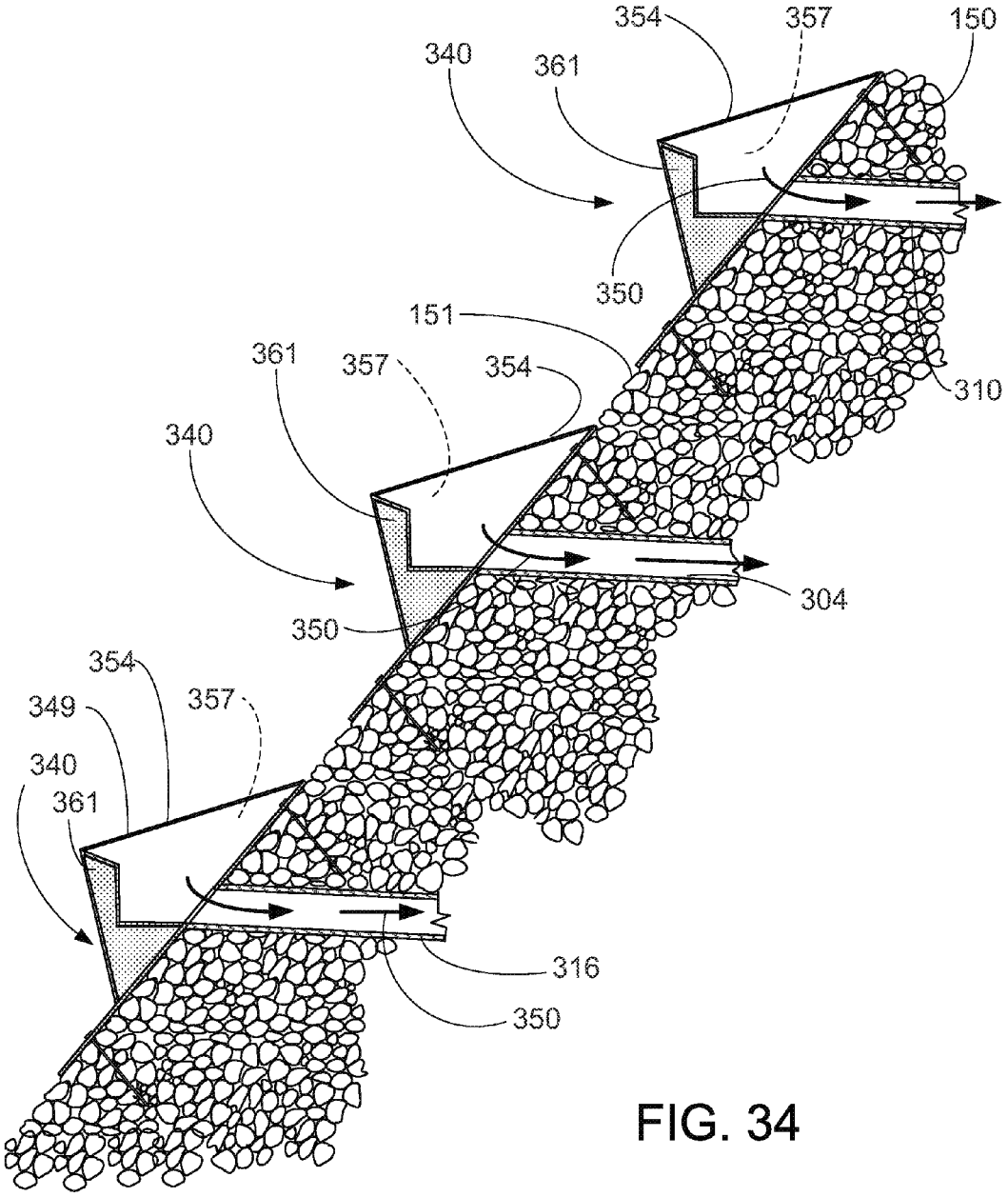
FIG. 34 illustrates a cross-section view of the multiple layers of drainage pipes in a drainage component of the WSSC System and a second embodiment of the construction of the continuous trough for receiving the flow of water and sediment into the drainage component.

Turning now to FIG. 34, there is seen an additional embodiment of the collection trough 340 as we discussed earlier in regard to FIGS. 31-33C. In this particular embodiment, there is provided the lower floor portion 347 as an extension of the collection pipes, and not at an angle as seen in FIGS. 32A and 32B. The floor 347 would terminate at an upright wall 348, that would terminate at an angulated upper shelf 349, with the outer support wall 345 extending down to the flat surface 343 secured to the jetty 150. In this trough 340 configuration, like the embodiment seen in the FIGS. 32A and B, would also have the filter screen 354 extending from the face of the jetty 150 to the upper shelf 349, so that water and sediment would flow through the screen 354 and would be collected first on the floor portion 347 and would then flow into the pipe openings 315. Therefore, it is foreseen that this would enable greater flow with the water and sediment into the pipes in this particular embodiment.

The embodiment described in FIG. 34, is seen clearly in FIGS. 35A and 35B, except that in FIG. 35B, there is no protective screen 354, but there is an open flow area 357 into the various collection pipes, as opposed to FIG. 35B which shows that there is in fact a protective screen 354 for preventing large rocks and other debris from flowing into the area 357.

Figure 31:
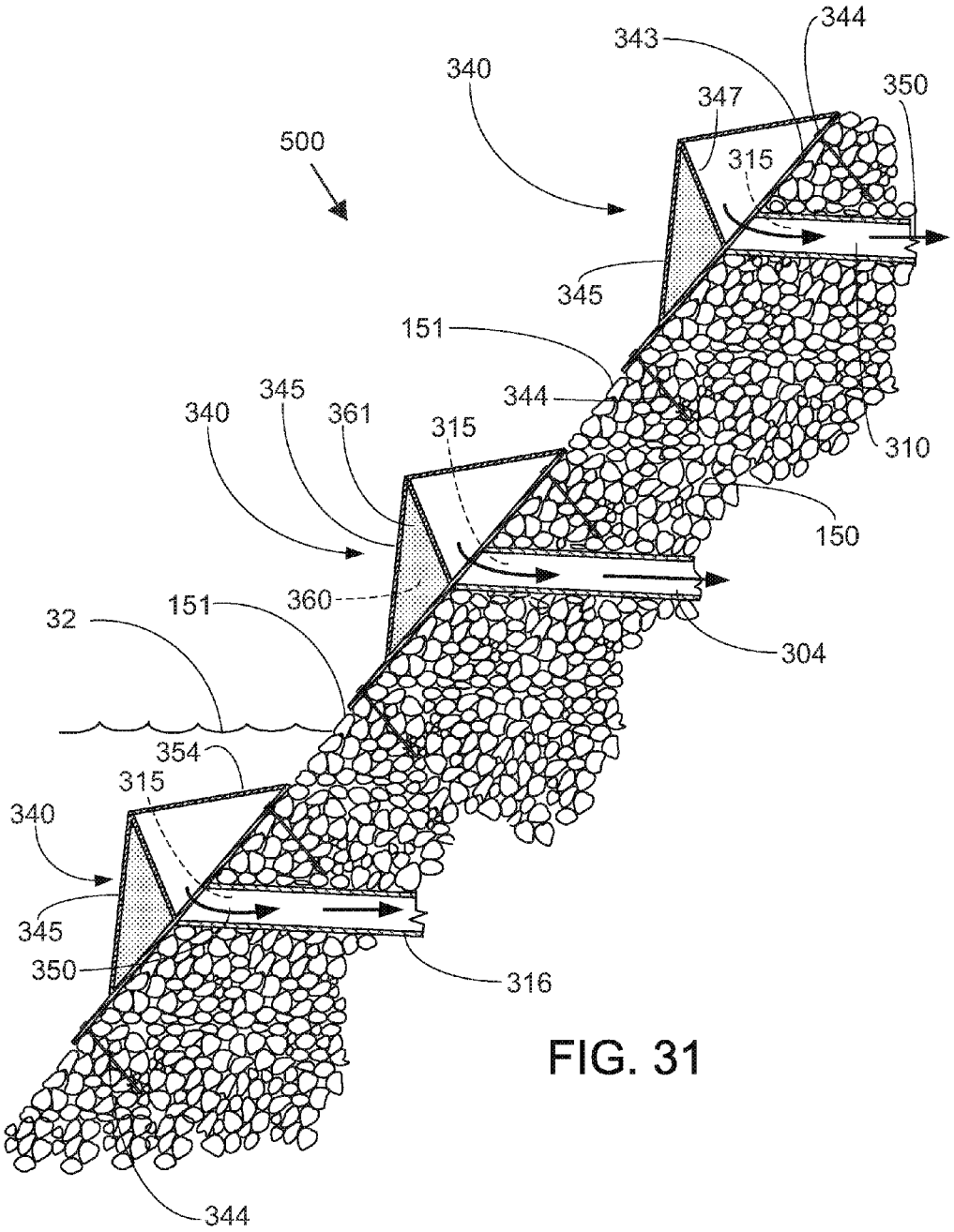
FIG. 31 illustrates a cross-section view of the multiple layers of drainage pipes in a drainage component of the WSSC System and a first embodiment of the construction of the continuous trough for receiving the flow of water and sediment into the drainage component.

For purposes of construction, as seen more clearly in FIGS. 31 and 32A and B, the area 360 formed by the outer wall 345 and floor 347 in both embodiments of trough 340 would be filled with water 361, for example, in order to give the troughs more weight against being dislodged from the wall of the jetty 150 in the event of a storm, for example.

FIG. 36A represents a longitudinal view of the embodiment shown in FIG. 35A with no collection screen 354 in place, while FIGS. 36B and C illustrate longitudinal views of the embodiment of the collection trough 340, as illustrated in 35B with the protective screen 354 in place.

Now that a discussion has been provided regarding the use of the WSSC System utilized as a system in open water, as described in FIGS. 1 through 17, and a discussion of the WSSC System being utilized with a rock jetty, as described in FIGS. 18-36C, reference is made to FIGS. 37 through 49 which illustrate the WSSC system, as described in FIGS. 1-17, as it may be utilized in what would be considered deep water.

In FIGS. 37 through 49, the modified WSSC system for use in deeper water is illustrated in various overall views and is designated by the numeral 500. For purposes of function, the WSSC deep water system 500 illustrated in FIGS. 37 through 49 functions very similarly, if not identically, to the system as described in FIGS. 1 through 17, which is the shallow water WSSC system 10. However, there are modifications in the structure of the system 500 which will be discussed in FIGS. 37-49. For purposes of the system 500, "deeper water" would be water deeper than the depth of shallow water in which the original system 10 would operate, but would not normally exceed 10 feet (3.05 meters) in depth.

Figures 37, 38:
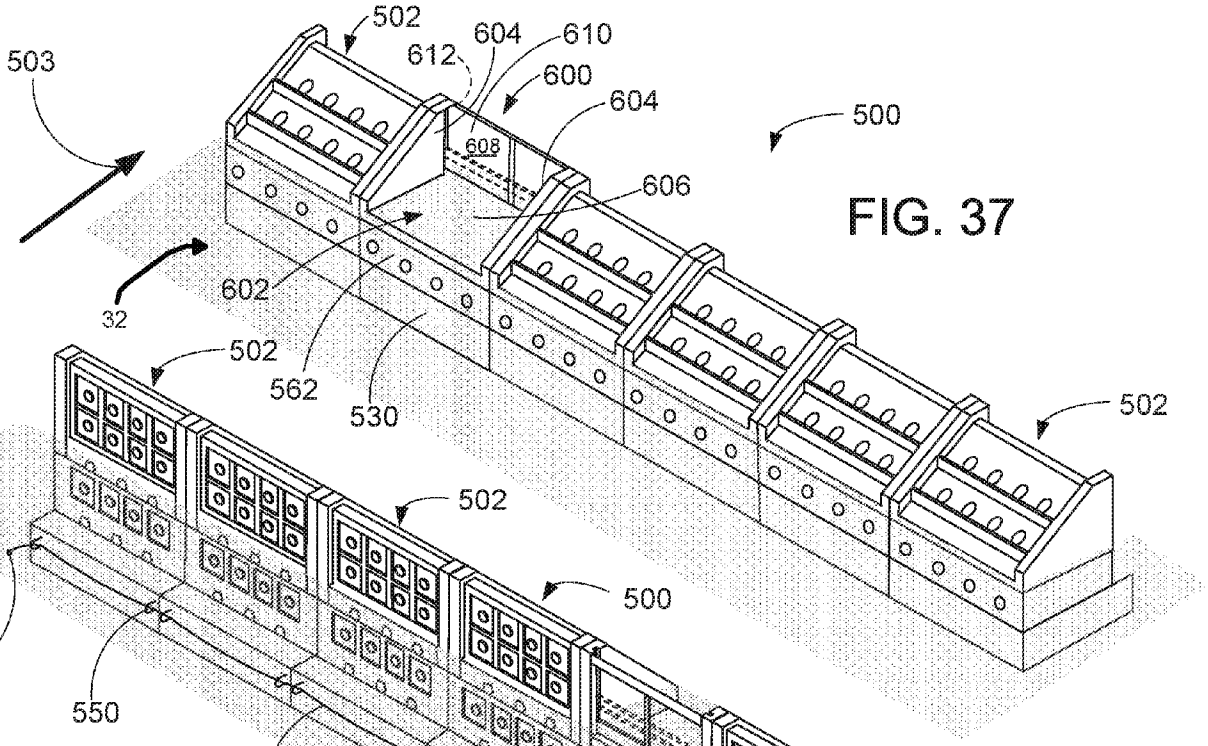
FIG. 37 illustrates an overall front view of the WSSC deep water system of the present invention.
FIG. 38 illustrates an overall rear view of the WSSC deep water system of the present invention.

Prior to a discussion of the structure of the individual components of the system as illustrated in FIGS. 39 through 49, reference is made to FIGS. 37 and 38 which illustrate an embodiment of the overall deep water WSSC system 500, also referred to herein as the system 500, in overall front and rear views respectively of the system 500 of the present invention. As illustrated, system 500 would comprise a plurality of individual units 502 which are positioned side by side to form the continuous deep water WSSC system 500. As illustrated, the system 500 is set along a shoreline, so that wave action from the body of water would flow through the system 500 to carry silt and other material through wave action in the direction of arrow 503 to be deposited to the rear of the system 500, as was described earlier with the shallow water system shown in FIGS. 1-17.

Turning now to the individual units and the manner in which each unit 502 is constructed, reference will be made to FIGS. 39 through 49. As illustrated in FIG. 39, unit 502 would have an upper portion 504 and a base portion 530. Although, as will be seen in other figures, a unit 502 may include a spacer portion 562 intermediate the upper portion 504 and base portion 530, as will be described further. As seen in FIG. 39, the upper portion 504 would include a floor portion 510 and a pair of side walls 512. There is provided a forward face 514, which would be positioned between the sidewalls 512 at an upward angle. There is provided a plurality of fluid flow openings 516 along the face 514 for receiving the flow of water and sediment (arrow 503) through flow pipes 517 formed through the body of upper portion 504 which would terminate in a flow opening 516 at the rear wall 518 of the upper portion 504, as illustrated in FIG. 43A. Each opening in the rear wall 518 for housing a flow pipe 517 would have a flapper valve 520, as illustrated in isolated view in FIG. 43B, to allow the water, carrying sediment, to flow out of the rear of upper portion 504, but to not allow the water to return through the flow pipes. Arrow 521 designates the location of one flapper valve 520 as shown in FIG. 43B on unit 575. Flapper valve 520 can open and close as indicated by arrow 519. To facilitate the collection of sediment in the water flow, the angled front or forward face 514 of each upper portion 504 would provide a continuous shoulder or shelf 522, extending between the side walls 512, and set below each set of flow openings 516 so that when the water flow, with sediment, enters each flow opening 516, that portion of sediment not entering the opening 516 would be collected on the upper face 523 of each shelf 522 to be forced into one of the flow openings 516 as the wave action continues. In a preferred embodiment, the shoulder or shelf 522 will be at a ninety (90) degree angle in relation to the forward face 514. As stated earlier, the function of the upper portion 504 is identical to the function of the unit 12 which was described in FIGS. 1 through 17.

Turning now to the modifications in the original system 10 to allow the system 500 to function in deep water, referring again to FIG. 38 and other figures following, the deep water system 500 would have the upper portion 504 secured to a base 530, to define a composite unit 531. Base portion 530 comprises an upper floor portion 532, a front wall portion 534, rear wall 536 and a pair of sidewalls 538, to define a substantially rectangular base 530. The base 530 is open on its lower end so that the base 530, when positioned on the floor of a body of water (See FIG. 48), is able to be pushed beneath the surface of the floor, and provide a means to be held securely in place during wave action, as a suction or vacuum seal is created. The upper portion 504, as illustrated, would be securely set on the upper floor 532 of base 530, through a system that will be described in other figures. As seen in FIGS. 39 and 40A and 40B, the forward edge of upper portion 504 is flush with the forward edge of base 530, so that a flange 540 on upper portion 504 would align with a flange 542 along base 530 to allow a pin, or as illustrated, a bolt 544 to be threaded through openings 546 in each flange 540, 542 and secured with a nut 548, so that the wave action against the unit 531 would not dislodge the upper portion 504 from the base 530. Each of the flanges 540, 542 would be secured by a plurality of gussets 549 spaced along their lengths. It should be noted that there are no flow openings 516 in the base 530, since the base 530 is utilized to provide a first level of height to the unit 531, and to provide a secure positioning in deep water conditions. As further illustrated, there is provided a cap or bong 551 on base 530, so that when the base 530 is pushed into the soft bottom of the body of water the bong or cap 551 is removed to allow trapped air to escape to be displaced by the mud entering the interior of the base 530. When in place, the bong 551 is reengaged, and the trapped air within base 530 forms a suction to prevent base 530 from being dislodged from the water bottom. When the unit 531 needs to be removed, there are provided a plurality of eyelets 550, on both the upper portion 504 and the base 530, which would allow a cable to be attached and lift the unit 531 as a single piece, or to lift the upper portion 504 and the base 530 separately, depending on the circumstances.

Figure 41:
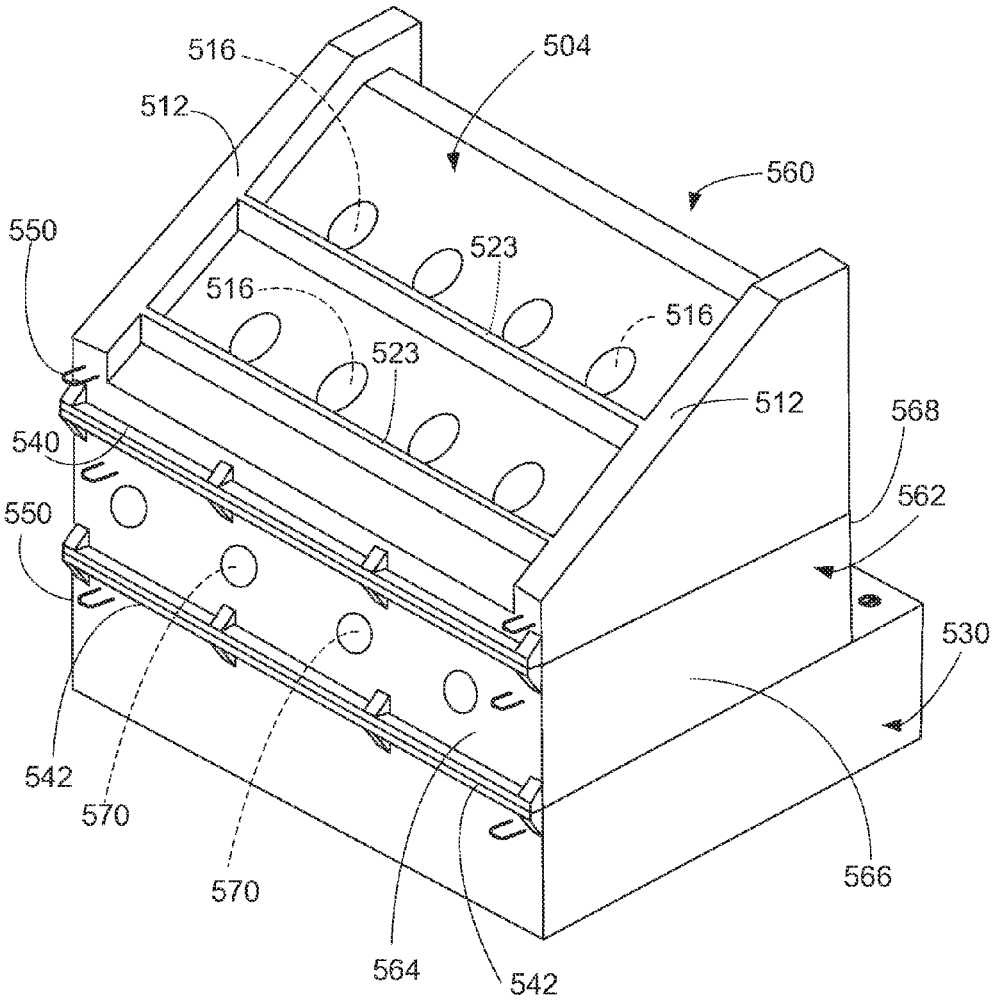
FIG. 41 illustrates an overall view of a unit of the deep water system having a spacer portion secured between the base portion and the upper portion.
Figure 42:
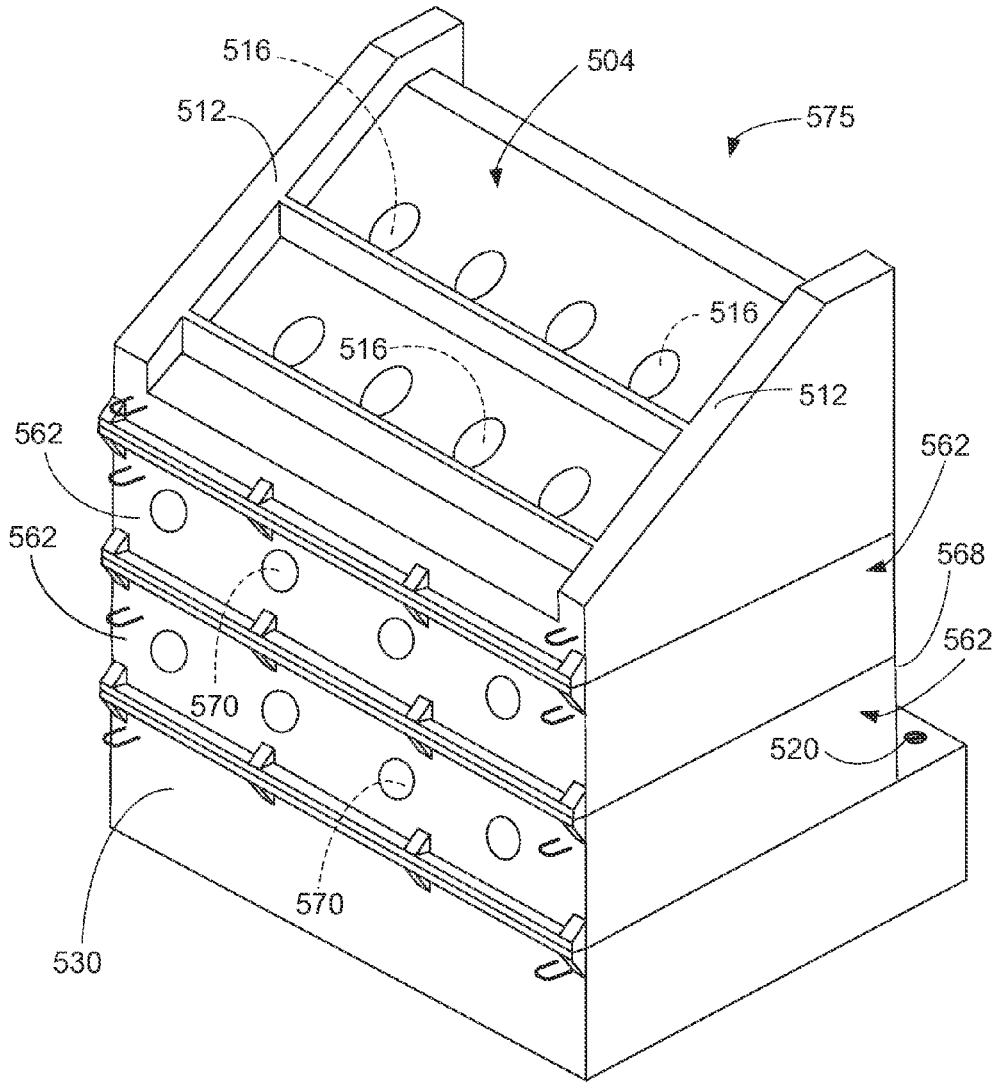
FIG. 42 illustrates an overall view of a unit of the deep water system having two spacer portions secured between the base portion and the upper portion.
Figure 43A:
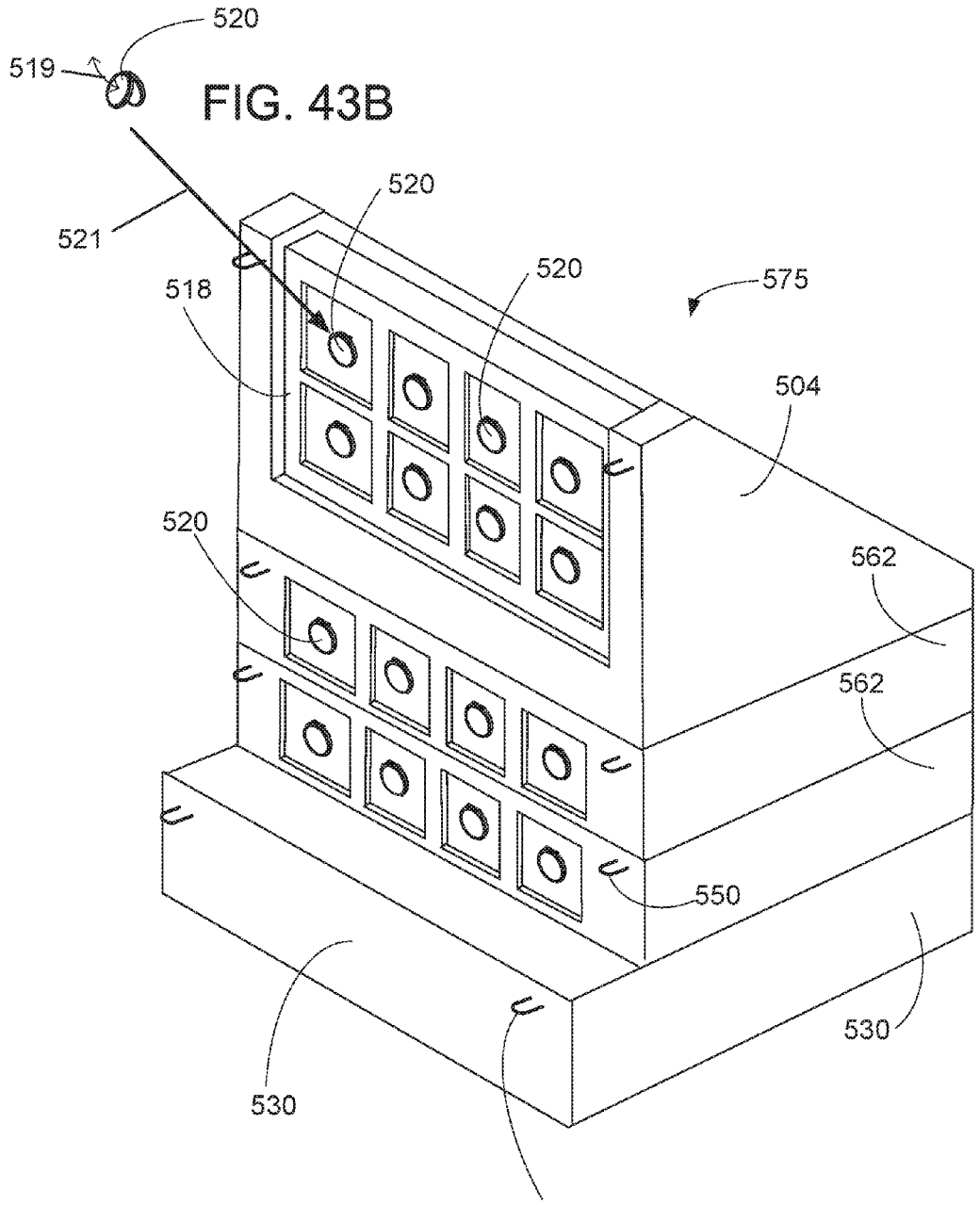
FIG. 43A illustrates an overall rear view of the unit illustrated in FIG. 42.
Figure 44A:
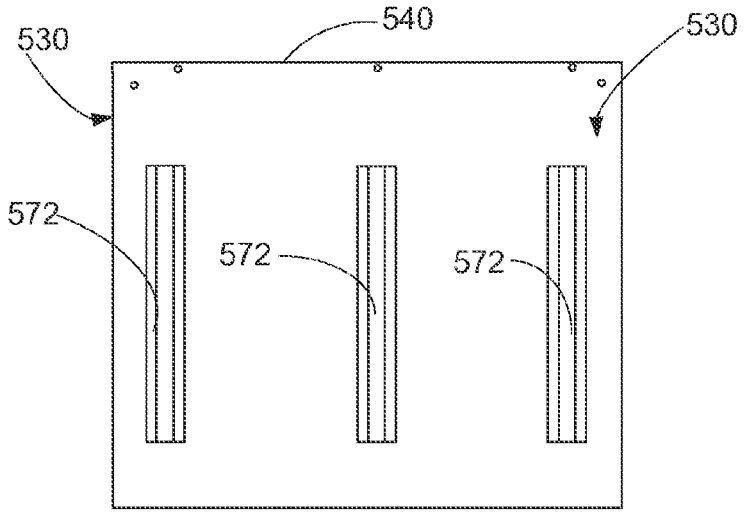
FIGS. 44A through 44C illustrated top, rear/end and bottom views respectively of the base portion of the present invention.
Figure 44B:
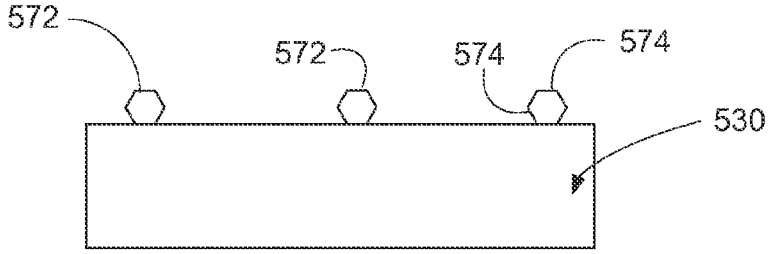
Figure 44C:
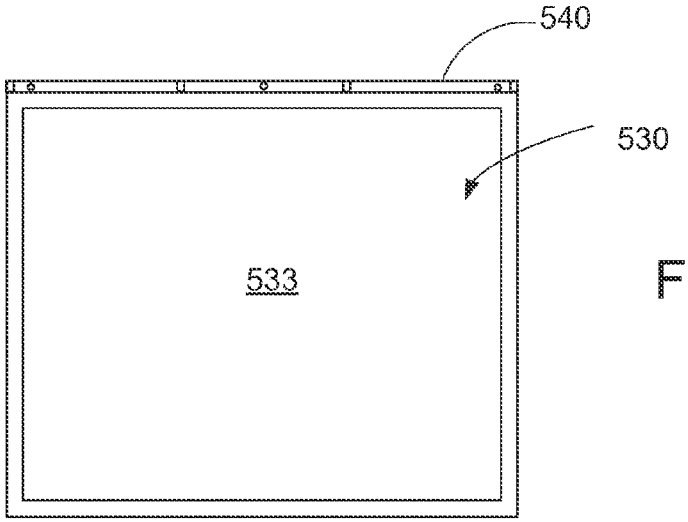
Figure 45A:
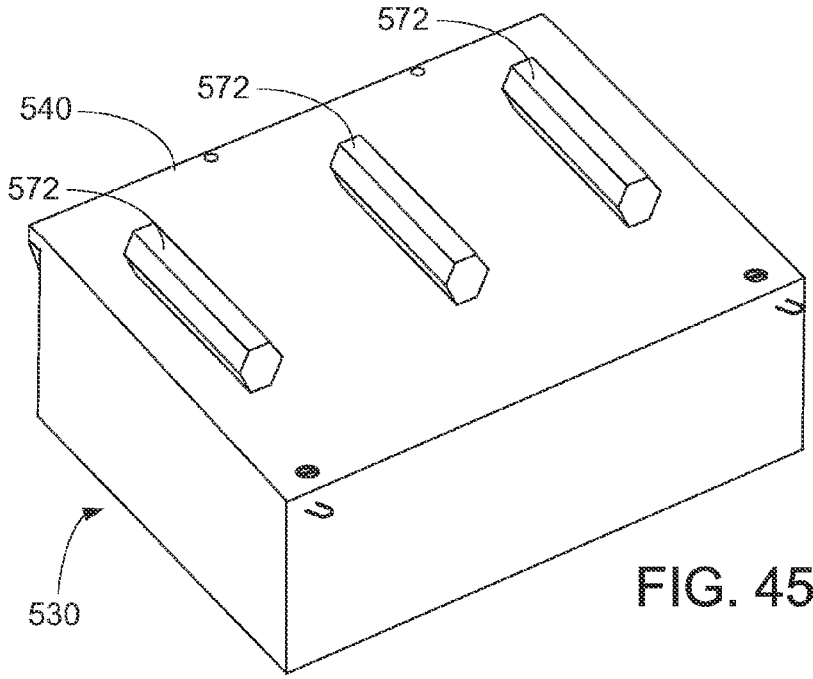
FIGS. 45A and 45B illustrate overall rear and front views respectively of the base portion of the present invention.
Figure 45B:
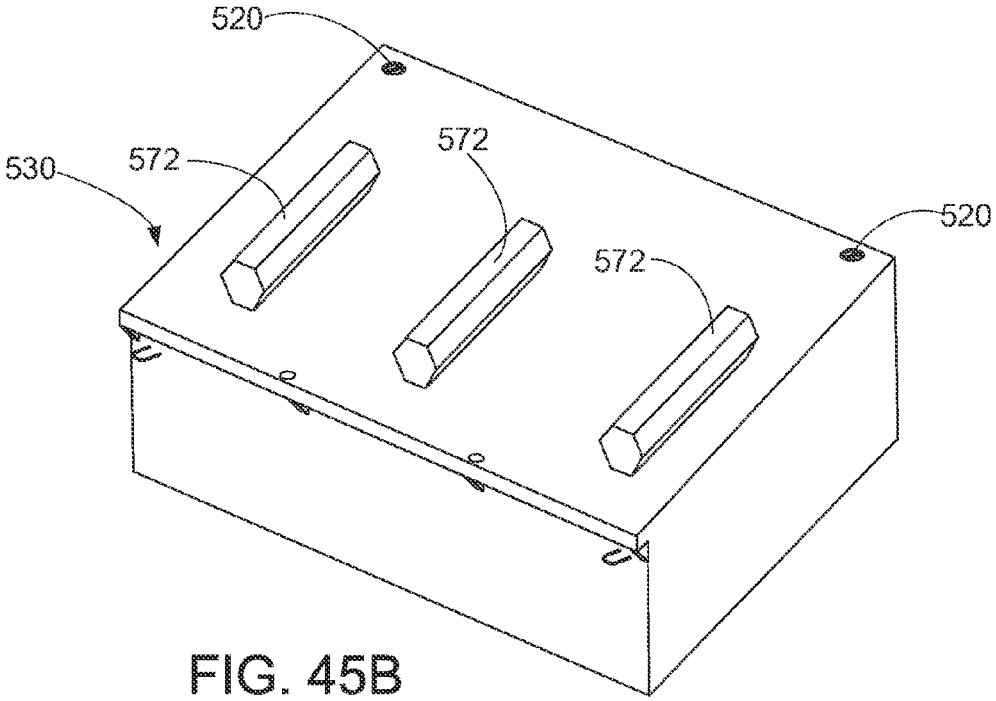
Figure 46A:
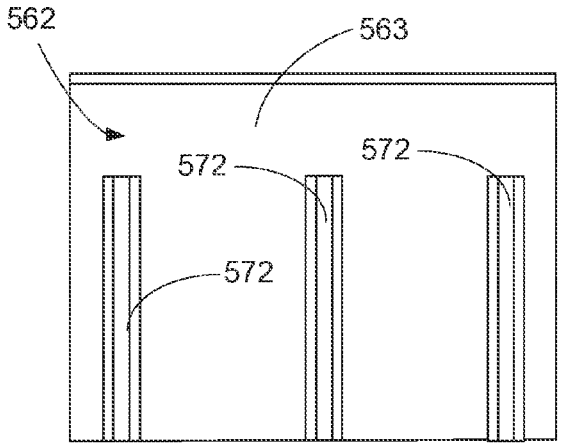
FIGS. 46A through 46C illustrated top, rear/end and bottom views respectively of the spacer portion of the present invention.
Figure 46B:
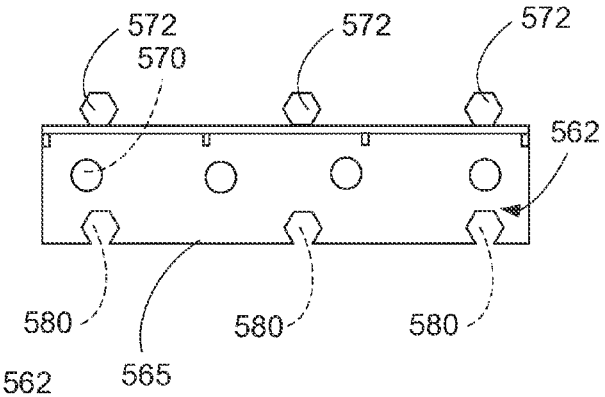
Figure 46C:
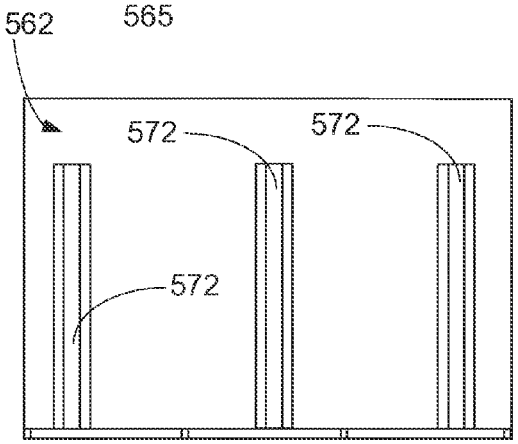
Figure 47A:
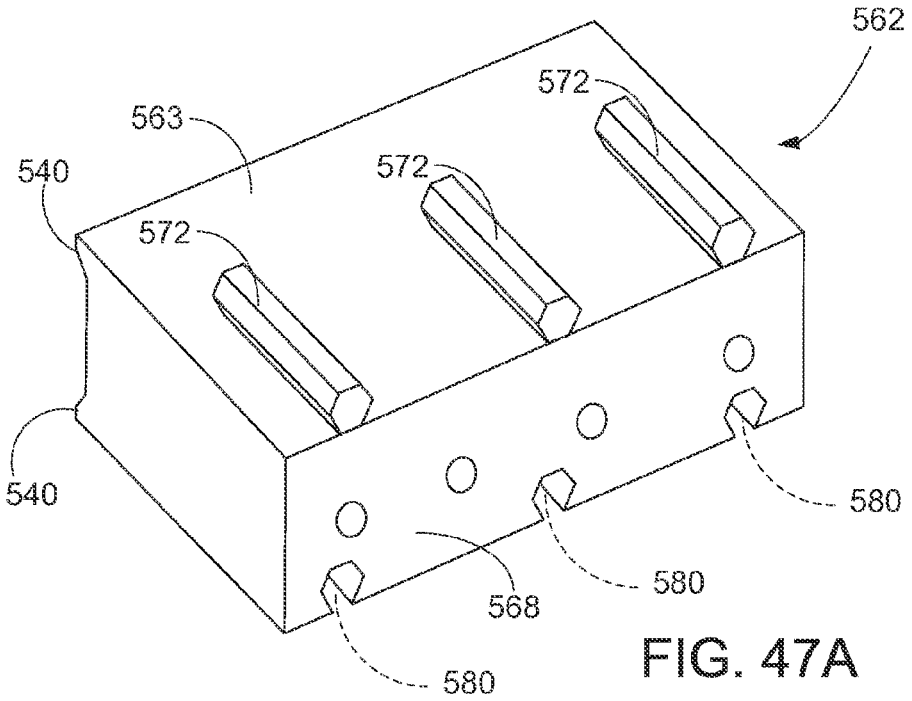
FIGS. 47A and 47B illustrate overall rear and front views respectively of the spacer portion of the present invention.
Figure 47B:
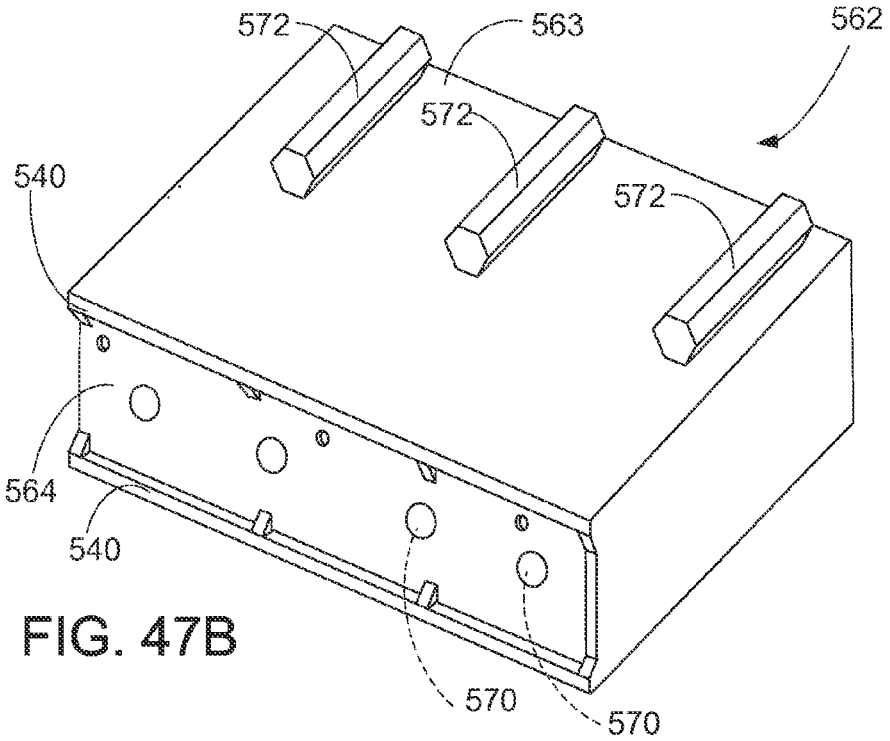

Turning now to FIGS. 41 and 42, reference is made to a modified unit 560, which comprises an upper portion 504, a base 530 and an intermediate spacer portion 562. As illustrated the upper portion 504 is designed identical to upper portion 504 described as part of unit 531. However, in unit 560, as illustrated, the upper portion 504 is secured to the spacer unit 562, rather than directly onto base 530, and the spacer portion 562 is attached to base 530. Again, there is provided the mating flanges between upper portion 504 and spacer portion 562 and between spacer portion 562 and base 530, all secured as discussed earlier. The second means for attaching the three portions together will be discussed in reference to other figures. As further illustrated, the spacer portion includes a front wall 564, a pair of side walls 566, and a rear wall 568. There are provided a plurality of flow pipes 570, preferably four pipes 570, with openings at the front wall 564 and terminating in openings at the rear wall 568. The function of these flow pipes 570 is identical to the flow pipes in the upper portion 504, to allow water and sediment to flow through the pipes 570 to be deposited to the rear of unit 560. Each flow pipe 570 would have a flapper valve 520 as did the flow pipes 517 of upper portion 504, to allow the water and sediment to flow out of pipes 570, but to prevent the return of the water and sediment due to the closing of valve 520. In addition to allowing more flow through the system or unit 560, the spacer portion 562 defines another means to raise the height of the system 500 for use in even deeper water, than would be enabled with just the upper portion 504 set upon the base 530.

In fact, referring to FIGS. 42 and 43A and B, there is illustrated a modified unit 575, which is comprised of an upper portion 504, a first upper spacer portion 562 and a second lower spacer portion 562 secured to the base 530, all defining unit 575. Each spacer portion 562 would be constructed and operated as discussed earlier, and each spacer portion 562 would be secured to the other portions as discussed earlier in relation to FIGS. 39 and 41. The unit 575, having two spacer portions 562 would allow for additional water and sediment flow through the flow pipes 570, and would provide even greater height to the system than was provided with unit 560, in FIG. 41. It is foreseen that each unit 575 of system 500 could accommodate first and second spacers 562, with each spacer 562 either 2 feet (0.61 meters) or 4 feet (1.22 meters) in height, but any more than two spacers of those height combinations may compromise the integrity of the system when met with wave action in a body of water.

As was referred to earlier, FIGS. 44 through 49 disclose what could be defined as the principal attachment means between the various components of each unit of the system 500, namely the base 530 and the spacers 562 and the upper portion 504. FIGS. 44A through 44C, illustrate top, end, and bottom views respectively of base 530. FIG. 44C illustrates that the base 530 has no bottom and is open ended to define an interior space 533 for the reasons stated earlier. In FIGS. 44A and 44B, there is illustrated the principal attachment means between the various portions of a particular unit. As seen there is provided a plurality of elongated hexagonal shaped members 572 formed on the top surface or upper floor portion 532 of the base 530, each member 572 having six sides 574, with one side forming the base of member 572. It is foreseen that each portion of each unit, including the hexagonal members 572, as will be described, would be molded as a single piece. Each elongated hexagonal member 572 is aligned to have a specific length and position on the surface or upper floor portion 532 of base 530. There would be provided a matching elongated hexagonal opening 580 in the rear wall and body of the top portion 504, for mounting the top portion 504 directly on base 530, or on the rear wall of spacer portion 562, if the composite unit includes one or more spacer portions 562. For example, in FIGS. 46A through 46C and 47A and 47B there are illustrated various views of a spacer portion 562. As seen in end or rear view in FIG. 46B, in addition to the flow openings 570, there are provided three hexagonal shaped openings 580 along the floor portion 565 which would be of a dimension and position to allow the hexagonal members 572 on base 530 to slidably engage into the hexagonal openings 580 in the spacer 562. Likewise, as seen in FIGS. 47A and 47B, the spacer 562 is provided with an equal number of members 572 on its upper surface 563 to engage with identical openings 580 in the floor 565 of a second spacer 562 to slidably engage upon it, or the upper portion 504 slidably engaged upon the spacer portion 562. Although the preferred shape of the elongated members 572 are hexagonal, it should be noted that the shape of the elongated hexagonal members 572 could include but not be limited to pentagonal, octagonal, or other such similar shapes as desired.

Figure 48:
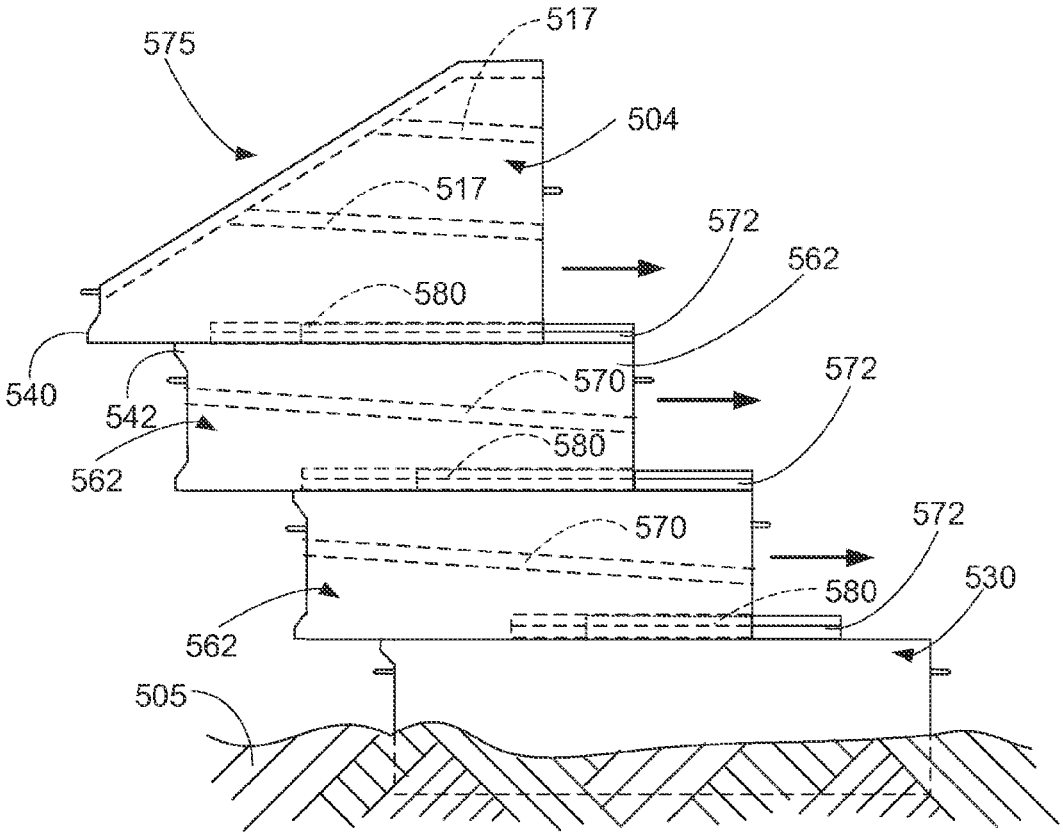
FIG. 48 illustrates a side view of the individual portions of a unit of the present invention being engaged to one another on the bottom of the seabed.
Figure 49:
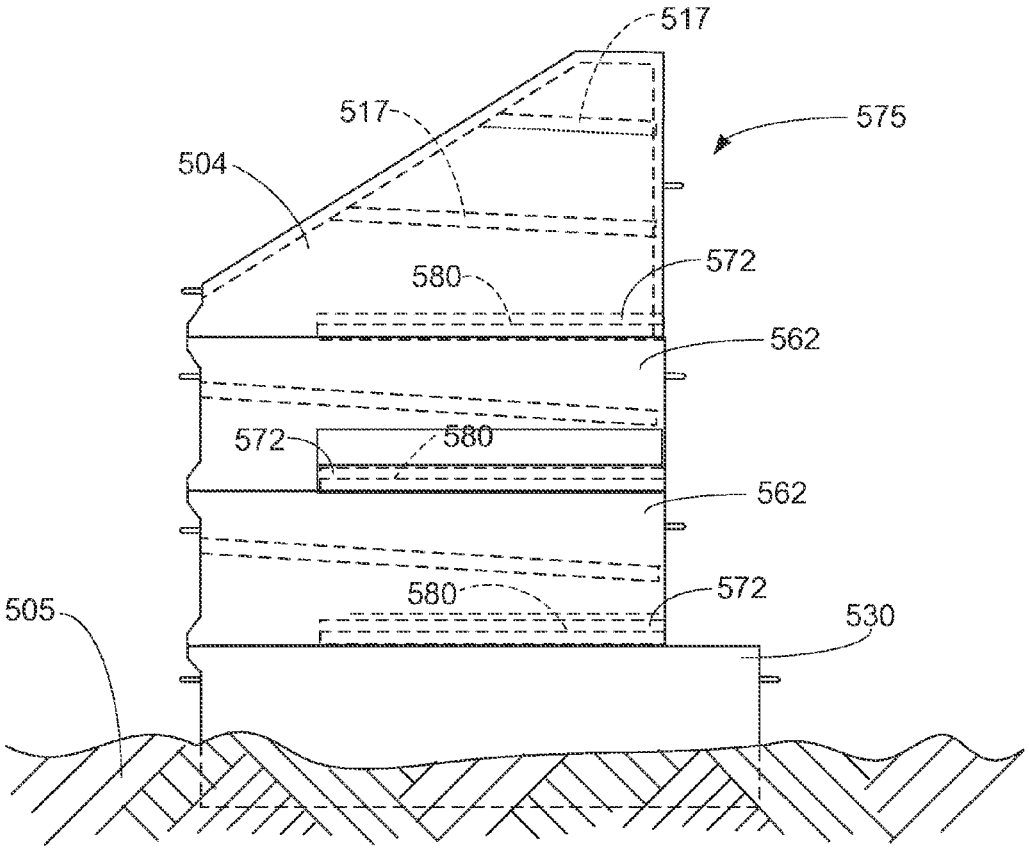
FIG. 49 illustrates in side view the assembled unit illustrated in FIG. 48 secured on the floor of the seabed.

This manner of engaging of the various portions of a unit, for example unit 575, is illustrated in FIGS. 48 and 49. In FIG. 48, the base 530 is secured into the water bottom 505. When in place, a first spacer portion 562 is engaged upon the base 530, by the hexagon members 572 of base 530 engaging into the three hexagonal openings 580 formed in the lower portion of spacer portion 562. Likewise, a second spacer 562 is being slidably engaged onto the upper portion of first lower spacer portion 562 in the same manner. Finally, the upper portion 504 is being engaged onto upper spacer portion 562 with the hexagon members 572 of upper spacer portion 562 sliding into the hexagonal openings 580 of upper portion 504. FIG. 49 illustrates an entire unit 575, with the base 530 in place, and the upper and lower spacer units 562 secured on top of the base, and the upper portion 504 in place, all secured with the principal mounting means as described above, and when all portions are in place, there could be provided the further securing of the portions with the flange members 540, 542 as described earlier.

Referring again to FIG. 49, for example, it should be noted that the hexagonal members 572 on the spacer portions 562 all terminate at the rear wall of each spacer portion. This is so that when the portion above is slidably engaged onto the spacer 562 below it, the rear walls will all align in a single vertical plane as seen in FIG. 49. And the length of the openings 580 are the same length of the hexagonal members 572, so that the members 572 once aligned cannot slide any further, so that wave action cannot push on the face of the members 572 and dislodge them from the portion below them. It should also be noted that the position of the hexagonal members 572 of the base is such that when a spacer 562, or the upper portion 504, is engaged, there is an upper portion of the base which extends beyond the vertical plane of the portions that are set upon the base 530.

It is foreseen that the eyelets 550, which were described earlier, could have a second function in addition to being used to lift and move the units. The eyelets 550 could be used to allow a cable to extend between units set side by side to prevent the possibility of the units becoming dislodged from the floor of the seabed. The cables could help maintain a dislodged unit in position until the unit could be reestablished into the soft seabed, as described earlier.

Returning now to the entire system 500 set in place in FIGS. 37 and 38, as illustrated, that system 500 is comprised of a plurality of units 560, each unit 560 having a base 530, a spacer 562 secured upon base 530 with the hexagonal attachment system described earlier, and an upper portion 504 likewise atop spacer portion 562 with the hexagonal attachment system. Of course, if the water 32 is of an increased depth, there could be provided at least a second spacer, preferably of 2 or 4 feet (0.61 or 1.22 meters) in height, to allow the system to operate under the deep water conditions. With the water 32 flow in the direction of arrow 503, the water 32 carrying sediment would flow through the flow openings 516 of flow pipes 517 in the upper portion 504, through wave action, and through the spacer portion 562, and upon exiting the rear of each portion, the flapper valves 520 would prevent the water 32 from returning, so the sediment would collect to the rear of the system 500, for recapturing and rebuilding lost land.

Since as with the original system as discussed in FIGS. 1 through 17, the water in an active sea system must return to the body of water, the system 500 is provided with a plurality of weirs 600 spaced along its length. Each weir portion 600 would also have a base portion 530, a spacer portion 562, if the system uses spacers, and an upper portion 602. Unlike a unit having an upper portion 504, as described, portion 602 would comprise a pair of wall portions 604, and a floor portion 606. There would be provided an adjustable rear wall 608, through a series of removable edge to edge flat members 610, the ends of which would be engaged in a continuous slot 612. The height of the weir 600 could be changed according to the conditions of the water, by the removal of one or more flat members 610 forming the weir 600, so that the weir 600 would always allow water to return from the rear of the system back into the body of water from whence it came.

The system 500 is positionable along a shoreline in the same manner as system 10 is depicted in FIGS. 12A and 12B herein, with the exception that securing the upper portion 504 to the base 530 and one or more spacers 562 would allow the system 500 to be placed in deeper water as compared to the system depicted in FIGS. 12A and 12B.

It is foreseen that the fabrication of the upper portion 504, spacer 562 and base portion 530 of each unit of the system 500 could be fabricated through rotational or the like molding process. Each of the portions could be transported through ground, air, or water to a location. The base 530 could be secured to the floor of the body of water as described herein. Once the base 530 is in place, at least one spacer 562 could be slidably engaged to the base via the hexagonal member attachment system, as explained herein, and then the upper portion 504 could be attached to the upper wall of the spacer (or base, if a spacer is not used) in the same manner, as seen in FIGS. 48 and 49. To further secure the portions as a single unit, the flanges 540 and 542 on the portions could be secured together with pins or bolts 544, as seen in FIGS. 40A and 40B. Also, as a final precaution, in order to further secure the system 500 in place, FIG. 38 illustrates a cable 585 which would extend through a plurality of eyelets 550 in each of the units which would make up system 500, and the cable 585 would be firmly mounted into the seabed at its first and second ends 587 through the length of the system 500 in order to maintain the units together should one or more unit become dislodged from the water bottom.

The following is a list of parts and materials suitable for use in the present invention.

PARTS LIST

| Part Number | Description |
|---|---|
| 10 | WSSC System |
| 12 | section |
| 14 | base |
| 15 | shoreline |
| 16 | sea floor |
| 17 | upper part |
| 18, 20 | side walls |
| 22 | rear wall |
| 24 | top wall |
| 26 | interior space |
| 28 | tubular members |
| 30 | rows |
| 31 | flow bore |
| 32 | water |
| 34 | sediment |
| 35 | rear opening |
| 36 | shoulder/shelf |
| 37 | space |
| 39 | arrows |
| 40 | flapper valve |
| 42 | valving member |
| 44 | inlet valve |
| 46 | outlet valve |
| 50 | barge |
| 52 | cable |
| 54 | boat |
| 60 | body of water |
| 61 | open sea |
| 62 | flow line |
| 63 | arrows |
| 64 | flow opening |
| 65 | arrows |
| 66 | weir |
| 68 | anchor loop |
| 70 | bottom edge |
| 72 | top anchor portion |
| 74 | elongated anchoring member |
| 80 | wave |
| 84 | area |

-continued

PARTS LIST

| Part Number | Description |
|---|---|
| 90 | barge |
| 92 | windmill |
| 96 | solar panel |
| 98 | air line |
| 99 | air compressor |
| 100 | storage tank |
| 102 | net |
| 104 | buoy |
| 112 | section |
| 113 | step |
| 117 | floor |
| 119 | entry |
| 121 | arrow |
| 123 | area |
| 130 | pipe |
| 132 | end |
| 150 | rock jetty |
| 151 | unprotected side |
| 152 | base |
| 153 | protected side |
| 156 | forward point |
| 158 | rear point |
| 200 | WSSC System |
| 201 | arrow |
| 202 | elongated pipes |
| 203 | principal flow pipe |
| 205 | pilings |
| 206 | rear end |
| 208 | trough |
| 210 | rear wall |
| 212 | angulated floor |
| 214 | side walls |
| 215 | point |
| 216 | entrance |
| 300 | WSSC system |
| 302 | collection component |
| 304 | principal pipe/principal flow pipe/principal drain pipe/principal collection pipe |
| 306 | sediment receiving end |
| 308 | outflow point |
| 310 | upper sediment receiving pipe |
| 312 | first end |
| 314 | second end |
| 315 | opening |
| 316 | lower sediment receiving pipe |
| 317 | first end |
| 318 | second end |
| 330 | support structure |
| 334, 335 | side collection pipes |
| 340 | collection trough |
| 343 | flat surface |
| 344 | mounting pins |
| 345 | lower support wall |
| 347 | floor |
| 348 | upright wall |
| 349 | upper shelf |
| 350 | arrows |
| 354 | filter screen |
| 357 | collection area |
| 360 | area |
| 361 | water |
| 500 | WSSC deep water system |
| 502 | units |
| 503 | arrow |
| 504 | upper portion |
| 505 | water bottom |
| 510 | floor portion |
| 512 | sidewalls |
| 514 | forward face |
| 516 | flow openings |
| 517 | flow pipes |
| 518 | rear wall |
| 519 | arrow |
| 520 | flapper valve |

-continued

| PARTS LIST | |
|---|---|
| Part Number | Description |
| 521 | arrow |
| 522 | shoulder or shelf |
| 523 | upper face |
| 530 | base portion |
| 531 | composite unit |
| 532 | upper floor portion |
| 533 | interior space |
| 534 | front wall portion |
| 536 | rear wall |
| 538 | sidewalls |
| 542 | flanges |
| 540, 544 | bolt |
| 546 | openings |
| 548 | nut |
| 549 | gussets |
| 551 | bong or cap |
| 550 | eyelets |
| 560 | modified unit |
| 562 | spacer portion/spacer unit/spacer |
| 563 | upper surface |
| 564 | front wall |
| 565 | floor portion |
| 566 | sidewalls |
| 568 | rear wall |
| 570 | flow pipes |
| 575 | modified unit |
| 572 | elongated hexagonal shaped members |
| 574 | sides |
| 580 | elongated hexagonal shaped openings |
| 585 | cable |
| 587 | first and second ends |
| 600 | weir |
| 602 | upper portion |
| 604 | wall portions |
| 606 | floor portion |
| 608 | adjustable rear wall |
| 610 | flat members |
| 612 | continuous slot |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A wave suppressor and sediment collection system, comprising:

a. at least one section having a forward wall, a rear wall, and a pair of sidewalls;

b. a plurality of flow bores positioned between the forward and rear walls, including a first group of flow bores, the plurality of flow bores each having an entrance proximate to the forward wall for receiving water and sediment flow therethrough;

c. at least one shelf having a rear end extending out from the forward wall and a forward end, the at least one shelf positioned below the first group of flow bores;

d. wherein at least a portion of at least one of the pair of sidewalls extends to the forward end of the at least one shelf; and e. wherein the at least one shelf disperses wave energy contacting the forward wall, while redirecting the wave energy for flowing sediment into the first group of flow bores and for collecting sediment that is not carried into the first group of flow bores and settles on the at least one shelf for being contacted by a following wave to carry the sediment into the first group of flow bores.

2. The wave suppressor and sediment collection system in claim 1, wherein the at least one section further includes a floor portion.

3. The wave suppressor and sediment collection system in claim 2 wherein the at least one section comprises a substantially buoyant material which allows each section to float in water before being filled with a material.

4. The wave suppressor and sediment collection system in claim 3, wherein the at least one section comprises an inlet valve capable of receiving the material into an interior of the section and an outlet valve for venting.

5. The wave suppressor and sediment collection system in claim 3, further comprising more than one section and wherein each of the more than one sections is connected to another section along one of the pair of sidewalls of each section.

6. The wave suppressor and sediment collection system in claim 3, wherein each section further comprises a plurality of anchors to secure each section in place.

7. The wave suppressor and sediment collection system in claim 2, wherein the wave suppressor and sediment collection system comprises at least one base portion connectable to the at least one section.

8. The wave suppressor and sediment collection system in claim 7, wherein the wave suppressor and sediment collection system further comprises at least one spacer portion including a plurality of flow bores, the spacer portion positioned intermediate the at least one base portion and the at least one section.

9. The wave suppressor and sediment collection system in claim 8, further comprising a valving element positioned on a rear end of each of the plurality of flow bores of the at least one section and the at least one spacer portion, for allowing water containing sediments to exit each flow bore, but preventing the water and sediments from returning through each flow bore.

10. The wave suppressor and sediment collection system in claim 8, further comprising more than one section with spacer and base portions and a height adjustable weir system, for allowing water flow to return to a main body of water but to maintain the sediment in place to a rear of the wave suppressor and sediment collection system.

11. The wave suppressor and sediment collection system in claim 8, wherein one of the said at least one sections, one of the said at least one spacer portions, and one of the said at least one base portions are injection molded as a single portion.

12. The wave suppressor and sediment collection system in claim 1, wherein the at least one section comprises concrete, recycled rubber, polyvinyl chloride (PVC), or high density polyethylene.

13. The wave suppressor and sediment collection system in claim 1, wherein the flow bores comprise sections of PVC material pipes.

14. The wave suppressor and sediment collection system in claim 1, further comprising more than one section and further comprising a weir system to allow water to return to a main body of water.

15. The wave suppressor and sediment collection system in claim 14, further comprising an air delivery system for stirring up additional sediment to be carried by wave action through the wave suppressor and sediment collection system.

16. A method for suppressing wave action against a shoreline and to collect sediment to build up the shoreline, comprising:

a. providing at least one body section, the at least one body section having:

i. a pair of sidewalls;

ii. a plurality of flow pipes extending between a front wall and a rear wall of the at least one section;

iii. a shelf extending out from the front wall below at least one of the plurality of flow pipes, the shelf having a forward face, and wherein the pair of sidewalls extends to the forward face of the shelf;

iv. the shelf positioned for shearing a wave and dispersing wave energy contacting the front wall, while redirecting the wave energy to allow sediment to flow into the plurality of flow pipes and for collecting sediment that is not carried into the plurality of flow pipes and settles on the shelf for being contacted by a following wave to carry the sediment into the plurality of flow pipes;

b. transporting the at least one section to a body of water; and c. lowering the at least one section into the body of water.

17. The method of claim 16 wherein steps (a)-(c) are repeated until multiple body sections are in place.

18. The method in claim 17 further comprising providing a weir system positioned between at least two of the body sections that allows the return of water to a body of water and traps sediment to the rear of the weir system and body sections.

19. The method in claim 17, further comprising providing an air delivery system in front of the body sections for stirring up additional sediment to be carried by wave action through the body sections.

20. The method in claim 16, further comprising providing a valve at a rear of each flow pipe for preventing water from flowing back through the flow pipes in each section.

* * * * *